US007617814B2

(12) United States Patent
Leppert

(10) Patent No.: US 7,617,814 B2
(45) Date of Patent: Nov. 17, 2009

(54) FUEL PUMP MODULE HAVING A DIRECT MOUNTED JET PUMP AND METHODS OF ASSEMBLY

(75) Inventor: Kevin L. Leppert, Lanexa, VA (US)

(73) Assignee: Synerjet, LLC, Newport News, VA (US)

( * ) Notice: Subject to any disclaimer, the term of this patent is extended or adjusted under 35 U.S.C. 154(b) by 0 days.

(21) Appl. No.: 12/394,717

(22) Filed: Feb. 27, 2009

(65) Prior Publication Data

US 2009/0223492 A1 Sep. 10, 2009

Related U.S. Application Data

(60) Provisional application No. 61/034,294, filed on Mar. 6, 2008.

(51) Int. Cl.
*F02M 37/04* (2006.01)

(52) U.S. Cl. ..... 123/509; 123/510; 123/514; 417/76; 417/79; 137/565.22

(58) Field of Classification Search ..... 123/509, 123/510, 514; 417/76, 79; 137/565.22
See application file for complete search history.

(56) References Cited

U.S. PATENT DOCUMENTS

| | | | |
|---|---|---|---|
| 3,901,025 | A | 8/1975 | Bryerton et al. |
| 4,408,961 | A | 10/1983 | Laybourne |
| 4,860,714 | A | 8/1989 | Bucci |
| 5,070,849 | A | 12/1991 | Rich et al. |
| 5,080,077 | A | 1/1992 | Sawert et al. |
| 5,289,810 | A | 3/1994 | Bauer et al. |
| 5,341,842 | A | 8/1994 | Chih et al. |
| 5,361,742 | A | 11/1994 | Briggs et al. |
| 5,452,701 | A | 9/1995 | Tuckey |
| 5,469,829 | A | 11/1995 | Kleppner et al. |

(Continued)

FOREIGN PATENT DOCUMENTS

| | | | |
|---|---|---|---|
| DE | 103 28 206 | A1 | 1/2005 |

(Continued)

OTHER PUBLICATIONS

International Search Report and Written Opinion for PCT/US2009/035947, mailed on Apr. 28, 2009.

*Primary Examiner*—Stephen K Cronin
*Assistant Examiner*—J. Page Hufty
(74) *Attorney, Agent, or Firm*—Cooley Godward Kronish LLP

(57) ABSTRACT

An apparatus includes a housing configured to receive a portion of a fuel pump. The housing defines a first flow path, a second flow path and a third flow path. The first flow path is in fluid communication with a fuel outlet portion of the fuel pump. The second flow path is in fluid communication with the first flow path. The third flow path is in fluid communication with the second flow path. A side wall of the housing defines a venturi within the second flow path at a location downstream from an intersection of the third flow path and the second flow path. A flow control member is disposed within the second flow path at a location upstream from the intersection of the third flow path and the second flow path. The flow control member is configured to regulate the fuel flow within the second flow path.

16 Claims, 17 Drawing Sheets

U.S. PATENT DOCUMENTS 5,655,504 A * 8/1997 Iwai ..... 123/511
5,715,798 A 2/1998 Bacon et al.
5,718,208 A 2/1998 Brautigan et al.
5,743,239 A 4/1998 Iwase
5,791,317 A 8/1998 Eck
5,960,775 A 10/1999 Tuckey
6,068,022 A 5/2000 Schultz et al.
6,155,793 A 12/2000 Tuckey et al.
6,213,726 B1 4/2001 Tuckey
6,253,735 B1 7/2001 Miyajima
6,260,543 B1 7/2001 Chih
6,343,589 B1 2/2002 Talaski et al.
6,424,924 B1 7/2002 Wagner et al.
6,488,476 B2 12/2002 Eck
6,575,705 B2 6/2003 Akiyama et al.
6,729,309 B2 5/2004 Schueler
6,928,989 B2 8/2005 Powell
6,966,302 B2 11/2005 Maroney
6,981,490 B2 1/2006 Nagata et al.
2003/0000502 A1 1/2003 Jones et al.
2003/0226548 A1 12/2003 Herzog et al.
2004/0000344 A1 1/2004 Okabe et al.
2005/0178853 A1 8/2005 Doble et al.
2006/0021603 A1 2/2006 Nagata
2006/0024176 A1 2/2006 Ikeya
2006/0096582 A1 5/2006 Powell et al.
2006/0130815 A1 6/2006 Gaffield et al.
2006/0231079 A1 10/2006 Paluszewski
2007/0128049 A1 6/2007 Sanchez et al.

FOREIGN PATENT DOCUMENTS

JP 0200526741 A 9/2005

* cited by examiner

FUEL PUMP MODULE HAVING A DIRECT MOUNTED JET PUMP AND METHODS OF ASSEMBLY

CROSS-REFERENCE TO RELATED APPLICATIONS

This application claims priority to U.S. Provisional Application Ser. No. 61/034,294, entitled "Fuel Pump Module Having a Direct Mounted Jet Pump and Methods of Assembly," filed Mar. 6, 2008, which is incorporated herein by reference in its entirety.

BACKGROUND

The embodiments described herein relate generally to fuel system components and more particularly to apparatus and methods for conveying liquid fuel within a fuel tank.

Some known fuel systems utilize a fuel pump mounted within the vehicle's fuel tank to draw fuel from the fuel tank and deliver it under pressure to an engine. In some known fuel systems, the fuel pump is disposed in a fuel reservoir and/or module within the fuel tank. Such fuel reservoirs and/or modules often contain only a portion of the fuel within the fuel tank. Accordingly, some known fuel systems include a jet pump, which is driven by the output flow of the fuel pump, to convey fuel from a remote region of the fuel tank to the reservoir and/or module within which the fuel pump resides. In some known systems, the jet pump can be located in the remote region of the fuel tank and can include a jet pump outlet hose to convey fuel from the remote region of the fuel tank to the reservoir and/or module within which the fuel pump resides. Similarly stated, in some known fuel systems, the jet pump can be remotely mounted in the fuel tank, spaced apart from the fuel pump. Such an arrangement can require additional separately located components within the fuel tank (e.g., mounting hardware), which can limit space inside the fuel tank. Moreover, such an arrangement can require additional operations to assemble and/or service the fuel system.

Thus, a need exists for an improved fuel pump module having an improved jet pump arrangement for transferring fuel within a fuel tank. A need also exists for methods for assembling and/or servicing a jet pump within a fuel system.

SUMMARY

Apparatus and methods related to fuel pump modules are described herein. In some embodiments, a fuel pump module includes a housing configured to receive a portion of a fuel pump, and a flow control member. The housing defines a first flow path, a second flow path and a third flow path. The first flow path is in fluid communication with a fuel outlet portion of the fuel pump. In this manner, the outlet flow from the fuel pump can flow into the first flow path when the portion of the fuel pump is disposed within the housing. The second flow path is in fluid communication with the first flow path. The third flow path is in fluid communication with the second flow path. A side wall of the housing defines a venturi within the second flow path at a location downstream from an intersection of the third flow path and the second flow path. The flow control member is disposed within the second flow path at a location upstream from the intersection of the third flow path and the second flow path. The flow control member is configured to regulate a flow of a fluid within the second flow path.

DETAILED DESCRIPTION

Figure 1:
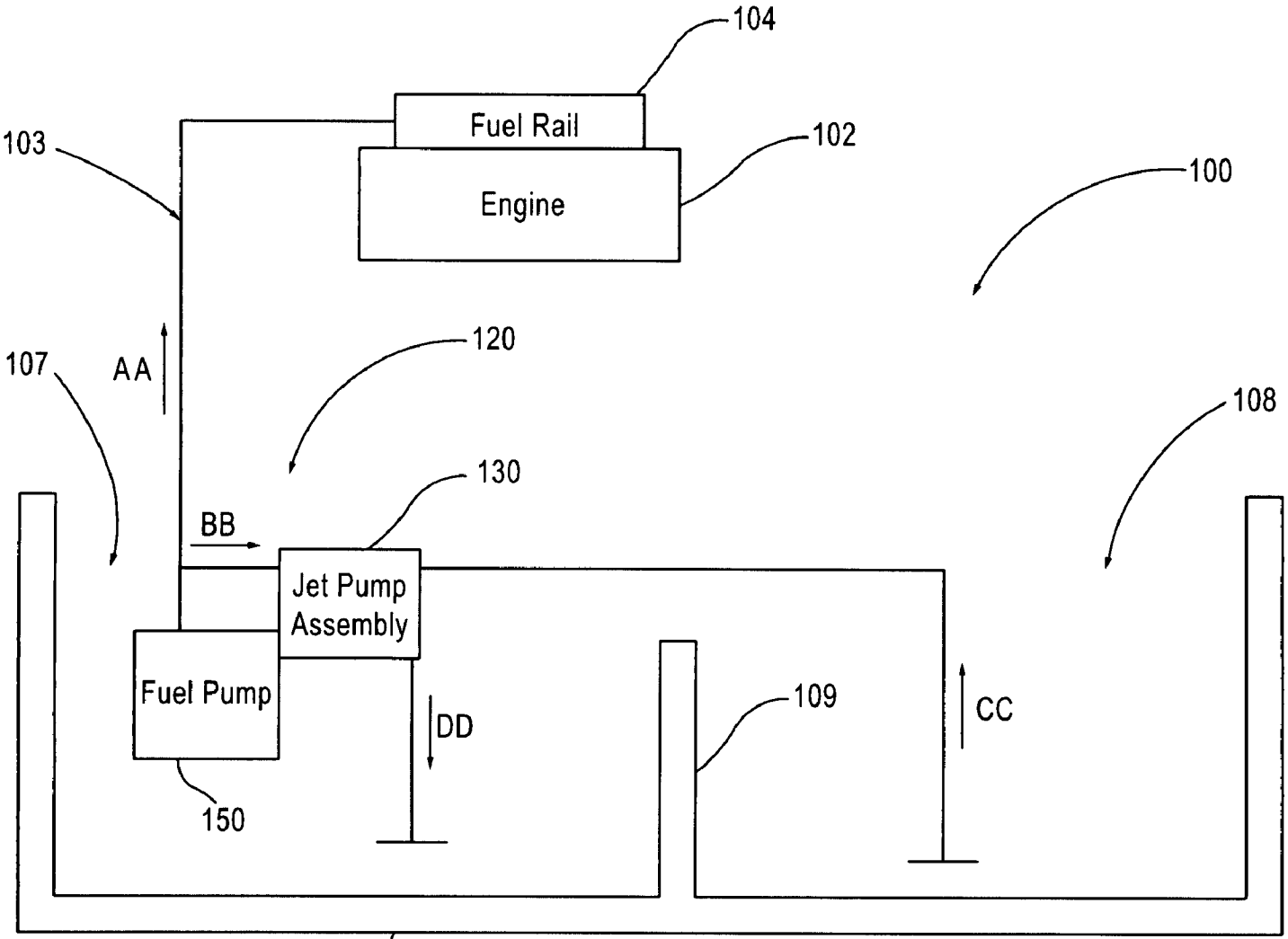
FIG. 1 is a schematic illustration of a fuel system according to an embodiment.

Apparatus and methods associated with providing fuel transfer within a fuel tank are disclosed herein. In some embodiments, an apparatus includes a housing configured to receive a portion of a fuel pump, and a flow control member. The housing defines a first flow path, a second flow path and a third flow path. The first flow path is in fluid communication with a fuel outlet portion of the fuel pump. In this manner, the outlet flow from the fuel pump can flow into the first flow path when the portion of the fuel pump is disposed within the housing. The second flow path is in fluid communication with the first flow path. The third flow path is in fluid communication with the second flow path. A side wall of the housing defines a venturi within the second flow path at a location downstream from an intersection of the third flow path and the second flow path. The flow control member is disposed within the second flow path at a location upstream from the intersection of the third flow path and the second flow path. The flow control member is configured to regulate a flow of a fluid within the second flow path.

In some embodiments, an apparatus includes a housing, a flow control member and an outlet fitting. The housing is configured to be directly coupled to a fuel pump. In some embodiments, for example, the housing can define a cavity and/or a recess within which a portion of the fuel pump is disposed. The housing defines a first lumen and a second lumen. The first lumen is in fluid communication with a fuel outlet portion of the fuel pump. The second lumen is in fluid communication with the first lumen. A side wall of the housing defines a venturi within the second lumen. The flow control member, which can be, for example, a calibrated orifice, is disposed within the second lumen at a location upstream from the venturi. The flow control member is configured to regulate a flow of a fluid within the second lumen. The outlet fitting is coupled to the housing such that the outlet fitting is in fluid communication with the first lumen. The outlet fitting and the second lumen define a parallel flow circuit.

In some embodiments, an apparatus includes a housing and a cap. The housing includes a fuel pump mounting portion and a cap mounting portion. The fuel pump mounting portion is configured to be directly coupled to an outlet of a fuel pump and defines a portion of a first flow path. The cap includes a first end portion and a second end portion. The first end portion of the cap includes an outlet fitting defining a portion of the first flow path. Fuel can be conveyed from the fuel pump to an engine via the first flow path. The first end portion of the cap includes a check valve disposed within a portion of the first flow path. The second end portion includes a mounting flange configured to be disposed outside of and coupled to the cap mounting portion of the housing. The second end portion of the cap and the cap mounting portion of the housing collectively define a portion of a second flow path in fluid communication with the first flow path. The second flow path includes a venturi. A flow control member is disposed within the second flow path at a location upstream from the third flow path. The flow control member is configured to restrict, control, and/or regulate the flow of a fluid within the second flow path.

In some embodiments, a method includes inserting a check valve into an outlet fitting. A flow control member is inserted into a bypass lumen defined by a jet pump housing. A surface of the jet pump housing defines a venturi within the bypass lumen. Moreover, the jet pump housing defines a primary flow lumen in fluid communication with the bypass lumen. The flow control member is configured to regulate a flow of fluid from the primary flow lumen to the bypass lumen. An outlet fitting is coupled to the jet pump housing such that the outlet fitting is in fluid communication with the primary flow lumen.

Figure 2:
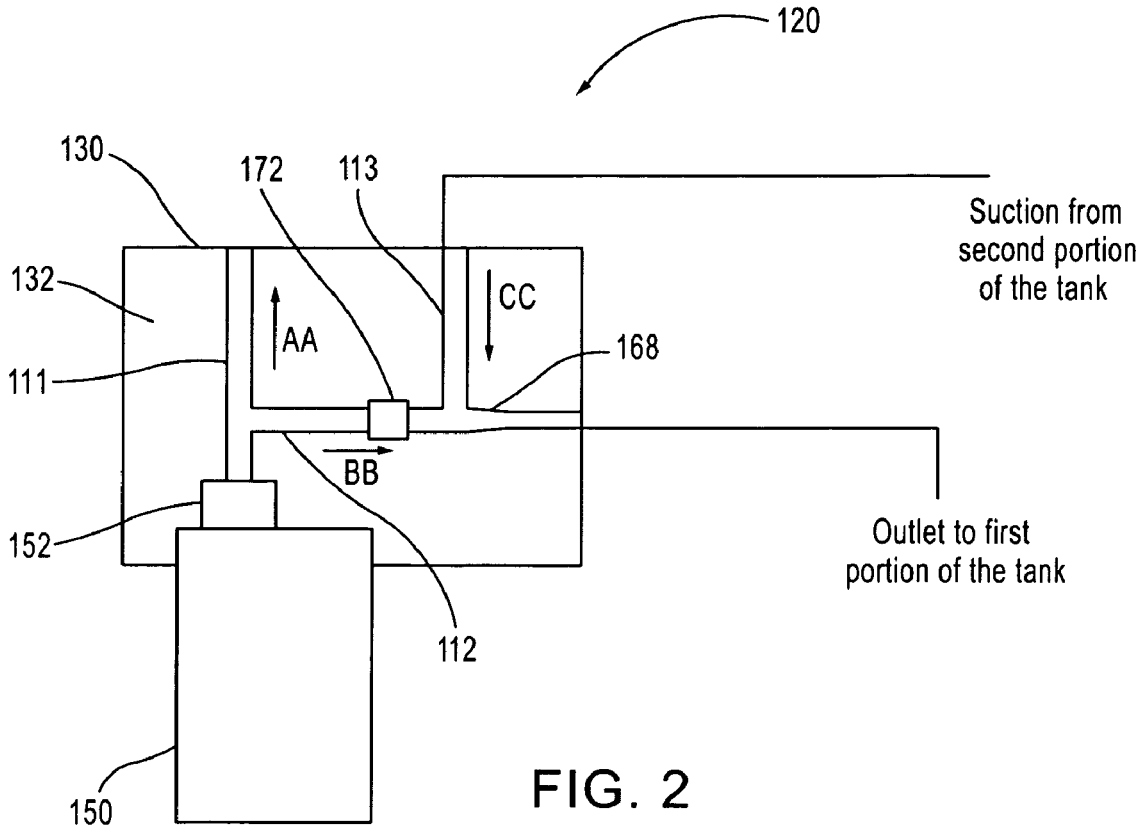
FIG. 2 is a schematic illustration of the fuel pump module shown in the fuel system of FIG. 1.

FIG. 1 is a flow schematic of a fuel system 100 including a jet pump assembly 130 according to an embodiment. FIG. 2 is a schematic illustration of the jet pump assembly 130 of the fuel system 100. The fuel system 100 includes a fuel tank 106, a fuel pump module 120, and a fuel rail 104. The fuel tank 106 includes at least one baffle 109 within the fuel tank 106. The baffle 109 can be, for example, any structural portion and/or structural member within the fuel tank 106. The baffle 109 is configured to separate and/or divide the fuel tank 106 into a first portion 107 and a second portion 108.

As shown, the fuel pump module 120 is disposed within the first portion 107 of the fuel tank 106. The first portion 107 and the second portion 108 are each configured to contain fuel for the fuel pump module 120. Although the fuel tank 106 is illustrated as including a first portion 107 and a second portion 108, in other embodiments, any suitable number of baffles can be used to form multiple portions within the fuel tank 106. For example, three, four, or more baffles can be used to create four, five, or more portions.

As shown in FIG. 2, the fuel pump module 120 includes a jet pump assembly 130 and a fuel pump 150. The jet pump assembly 130 includes a housing 132 and a flow control member 172. The housing 132 defines a first flow path (or lumen) 111, a second flow path (or lumen) 112, and a third flow path (or lumen) 113. The second flow path 112 is in fluid communication with the first flow path 111 and the third flow path 113. Said another way, the second flow path 112 intersects the first flow path 111, and the third flow path 113 intersects the second flow path 112. A portion of the sidewall of the housing 132 defines a venturi 168 within the second flow path 112 at a location downstream from the intersection of the second flow path and the third flow path 113. Said another way, a portion of the second flow path 112 includes a converging portion having an inlet portion with a first diameter and an outlet portion with a second diameter less than the first diameter.

The housing 132 of the fuel pump module 120 is configured to receive at least a portion of an outlet portion 152 of the fuel pump 150. In this manner, the outlet portion 152 of the fuel pump 150 is in fluid communication with the first flow path 111. Accordingly, as described in more detail herein, outlet flow of fuel from the fuel pump 150 can be conveyed from the fuel pump 150 to the engine 102 via the first flow path 111, as indicated by arrow AA.

The flow control member 172 is disposed within the second flow path 112 at a location upstream from the third flow path 113. Said another way, the flow control member 172 is disposed within the second flow path 112 at a location upstream of the intersection of the third flow path 113 and the second flow path 112. The flow control member 172 is configured to restrict, control, and/or regulate the flow of fuel within the second flow path 112. The flow control member 172 can be, for example, a plug defining an orifice therethrough.

In use, the fuel pump 150 receives fuel from the first portion 107 of the fuel tank 106 via a fuel inlet portion (not shown in FIGS. 1 and 2). The fuel pump 150 pumps fuel into the jet pump assembly 130 via the outlet portion 152. More particularly, pressurized fuel from the outlet portion 152 of the fuel pump 150 is conveyed through the first flow path 111 to the fuel injector rail 104 through fuel supply line 103 as indicated by the arrow AA in FIGS. 1 and 2. Pressurized fuel from the outlet portion 152 of the fuel pump 150 is also conveyed to the second flow path 112, as indicated by the arrow BB. In this manner, the first flow path 111 and the second flow path 112 define a parallel flow circuit through which fuel from the outlet portion 152 can flow. The flow rate of fuel within the second flow path 112 is controlled by the flow control member 172. Said another way, the flow control member 172 regulates the fuel flow split and/or the ratio of fuel flow between the first flow path 111 and the second flow path 112. In some embodiments, the flow control member 172 can include an orifice to control the flow into the second flow path 112. For example, a flow control member 172 having a large orifice can allow more fuel through the second flow path 112 than would a flow control member 172 having a small orifice.

When fuel flows through the second flow path 112 and passes through the venturi 168, the local pressure of the fuel within the portion of the second flow path 112 adjacent the venturi 168 decreases compared to the pressure of the fuel within the remainder of the second flow path 112. Said another way, when fuel passes through the venturi 168, a localized area of low pressure and/or vacuum is produced. Accordingly, the vacuum causes fuel to be drawn from the second portion 108 of the fuel tank 106 into the third flow path 113 as indicated by the arrow CC. The fuel flowing within the third flow path 113 is combined with the fuel flowing within the second flow path 112 and is returned to the tank 106 as shown by the arrow DD in FIG. 1. More particularly, the fuel exiting the jet pump assembly 130 is directed to the first portion 107 of the tank 108 (i.e., adjacent the fuel pump 150). In this manner, fuel can be transferred from the second portion 108 of the tank 106 to the first portion 107 of the tank 106 adjacent to the fuel pump 150 to prevent starvation of the fuel pump 150. Similarly stated, this arrangement allows, fuel to be transferred from a remote portion of the tank 106 to the first portion 107 of the tank 106 adjacent to the fuel pump 150 to prevent starvation of the fuel pump 150.

Although the fuel pump module 120 is shown as being disposed within the first portion 107 of the tank 106 such that the fuel pump 150 draws fuel from the first portion 107 of the tank 106, in some embodiments, the fuel pump 150 can be disposed within a container (not shown in FIGS. 1 and 2) within the tank 106 such that the fuel pump 150 draws fuel from a reservoir within the container. Said another way, in some embodiments, the fuel tank 106 can be divided into multiple portions by the container. Said yet another way, in some embodiments, the fuel pump module 120 can include a reservoir from which the fuel pump 150 can draw fuel. In such embodiments, the fuel flow from the jet pump assembly 130, as shown by the arrow DD in FIG. 1, can be directed to the container and/or reservoir.

Although the fuel pump module 120 is illustrated in FIG. 1 as being disposed within the first portion 107 of the fuel tank 106, in other embodiments, the fuel pump module 120 can be disposed within the second portion 108 of the fuel tank 106. If more than two portions are used within a fuel tank, the fuel pump module 120 can be disposed within any of the formed portions. Although the fuel pump module 120 is shown as being disposed within the fuel tank 106, alternatively, the fuel pump module 120 can be disposed and secured outside the fuel tank 106.

Although the jet pump assembly 130 is shown and described above as being configured to receive at least a portion of the outlet portion 152 of the fuel pump 150, in other embodiments, the jet pump assembly 130 can be configured to be received within the fuel pump 150. Said another way, the fuel pump 150 can be configured to receive at least a portion of the jet pump assembly 130. Alternatively, the jet pump assembly 130 and the outlet portion 152 of the fuel pump 150 can be directly coupled in any suitable manner. Said another way, the jet pump assembly 130 can be connected to the outlet portion 152 of the fuel pump 150 without any intervening structure (e.g., without any hoses, clamps, fittings, etc.).

The fuel supply line 103 coupling the fuel pump module 120 and the fuel injector rail 104 can be any suitable fuel line configured to convey fuel within the fuel system 100. For example, in some embodiments, the fuel supply line 103 can be a rubber hose, a thermoplastic tubing (e.g., polyamide tubing, PTFE tubing, or the like), a hose containing a metallic braid, a composite fuel line, or the like. In some embodiments, for example, the fuel line can be a composite fuel line that includes a thermoplastic tubing covered by a rubber exterior. One example of such a composite fuel line is a composite fuel line manufactured by Pilot Industries under the trade name P-Cap™.

Figure 3:
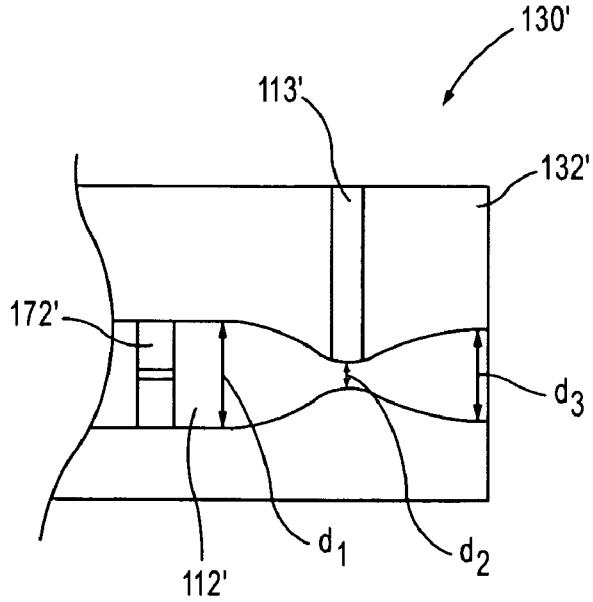
FIG. 3 is a schematic illustration of a portion of a jet pump assembly according to an embodiment.

Although the venturi 168 is shown as converging from a first diameter to a second diameter less than the first diameter, in other embodiments the venturi 168 can include both a converging portion and a diverging portion. Although the third flow path 113 is shown as intersecting the second flow path 112 upstream of the venturi 168, in other embodiments, the third flow path 113 can intersect the second flow path 112 along the portion of the second flow path 112 that defines the venturi 168. For example, FIG. 3 is a schematic illustration of a portion of a jet pump assembly 130' according to an embodiment. The jet pump assembly 130' includes a housing 132' and a flow control member 172'. The housing 132' defines a first flow path (not shown), a second flow path (or lumen) 112', and a third flow path (or lumen) 113'. Similar to the jet pump assembly 130 shown and described above, the second flow path 112' is in fluid communication with the first flow path and the third flow path 113'.

A portion of the sidewall of the housing 132' defines a converging-diverging venturi 168' within the second flow path 112'. More particularly, the second flow path 112' includes a converging portion having an inlet diameter d1 converging to a throat diameter d2. The second flow path 112' includes a diverging portion from the throat diameter d2 to an outlet diameter d3. In this manner, when fuel flows through the second flow path 112' and passes through the venturi 168', the local pressure of the fuel within the portion of the second flow path 112' within the venturi 168', with lowest pressure occurring substantially adjacent the throat (i.e., the portion of the venturi 168' having the smallest diameter, as identified by the diameter d2). As shown in FIG. 3, the third flow path 113' intersects the second flow path 112' along the venturi 168' of the second flow path 112'. More particularly, the third flow path 113' intersects the second flow path 112' substantially at the throat of the venturi 168'.

Figure 4:
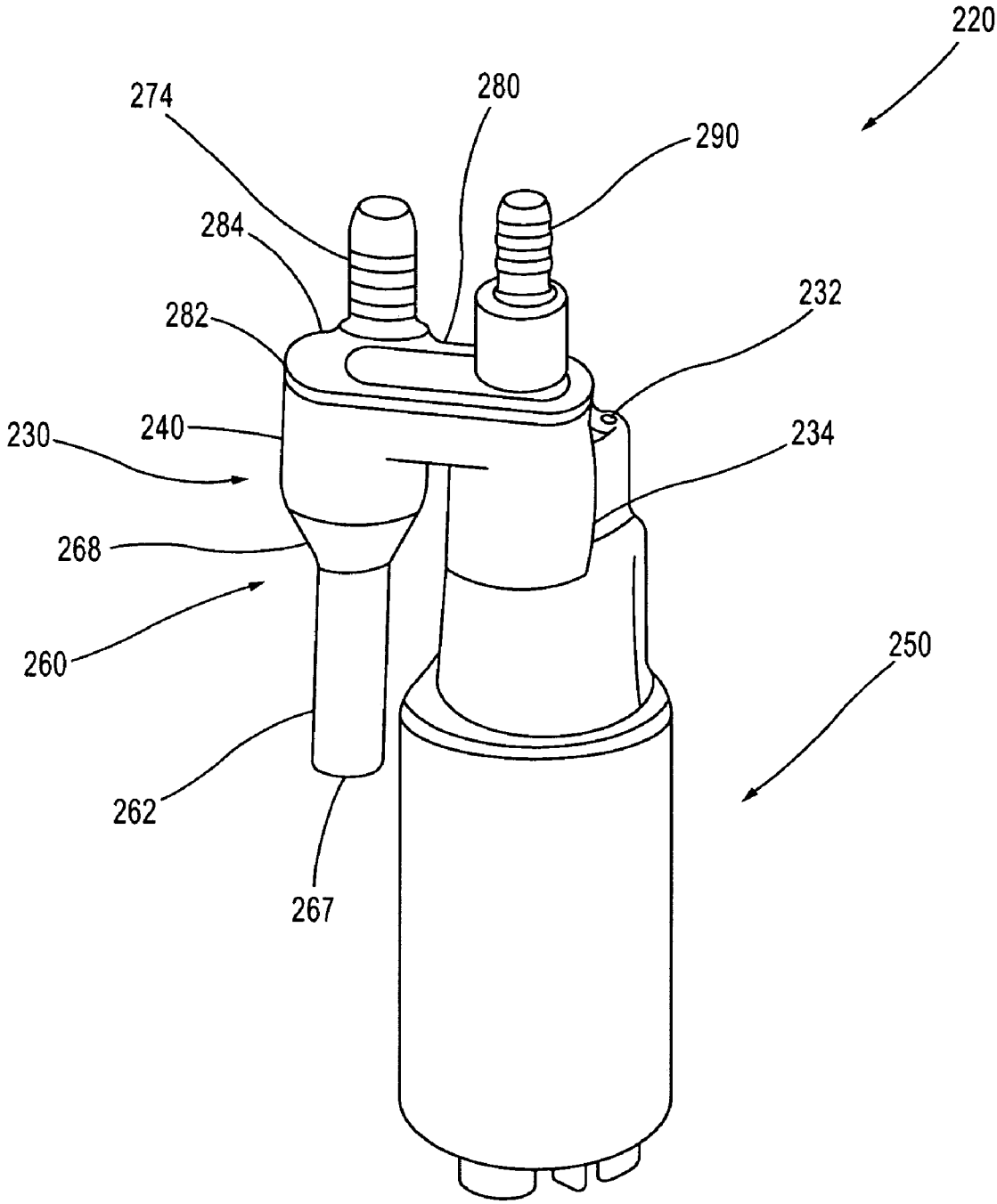
FIG. 4 is a perspective view of a fuel pump module according to an embodiment.
Figure 5:
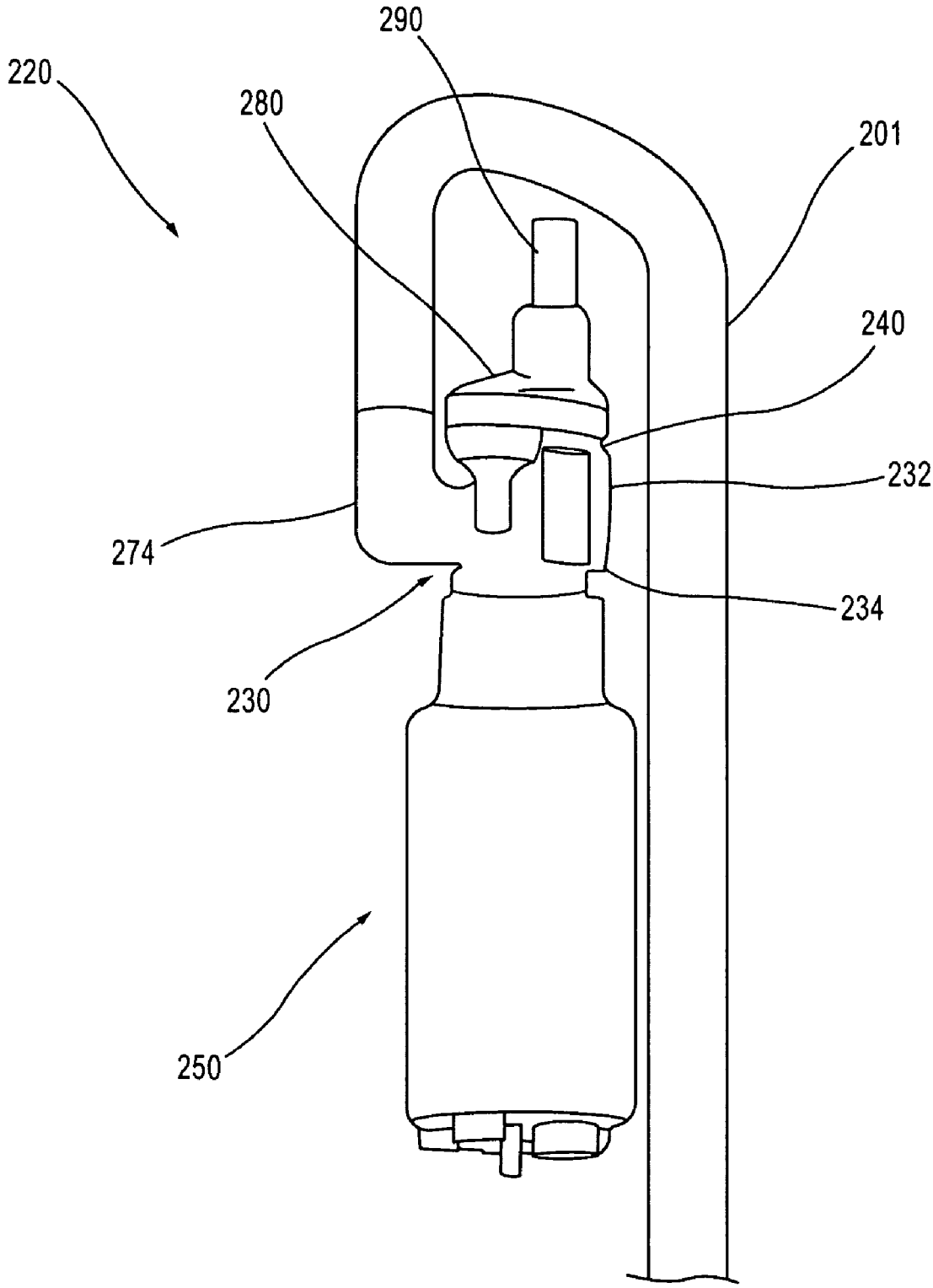
FIG. 5 is a perspective view of a portion of the fuel pump module shown in FIG. 4 including an inlet tube.

FIG. 4 is a perspective view of a fuel pump module 220 according to an embodiment. The fuel pump module 220 is configured to be disposed within a portion of a fuel tank (not shown). The fuel pump module 220 includes a jet pump assembly 230 and a fuel pump 250. The jet pump assembly 230 is configured to receive at least a portion of an outlet portion of the fuel pump 250. FIG. 5 is a perspective view of a portion of the fuel pump module 220, with certain portions (e.g., the outlet tube 262) shown as transparent for purposes of clarity.

As shown in FIG. 6-12, the jet pump assembly 230 includes a housing 232 and a cap 280. The housing 232 includes a first end portion 234 (i.e., a fuel pump mounting portion), a second end portion 240 (i.e., cap mounting portion), and a jet pump portion 260. The first end portion 234 of the housing 232 defines a first flow path (or lumen) 211 (see e.g., FIGS. 9 and 12). The first end portion 234 of the housing 232 includes a sleeve 236 disposed within the first flow path 211. The sleeve 236 defines a lumen 233 having a longitudinal axis A-A as shown, for example in FIGS. 7 and 10. The longitudinal axis A-A is coaxial with a longitudinal axis of the fuel pump 250 and is further coaxial with a longitudinal axis of a lumen 298 defined by the cap 280 (described in more detail herein). The first flow path 211 is configured to convey fuel in the direction as indicated by arrow EE as shown, for example, in FIGS. 10 and 12.

Figure 10:
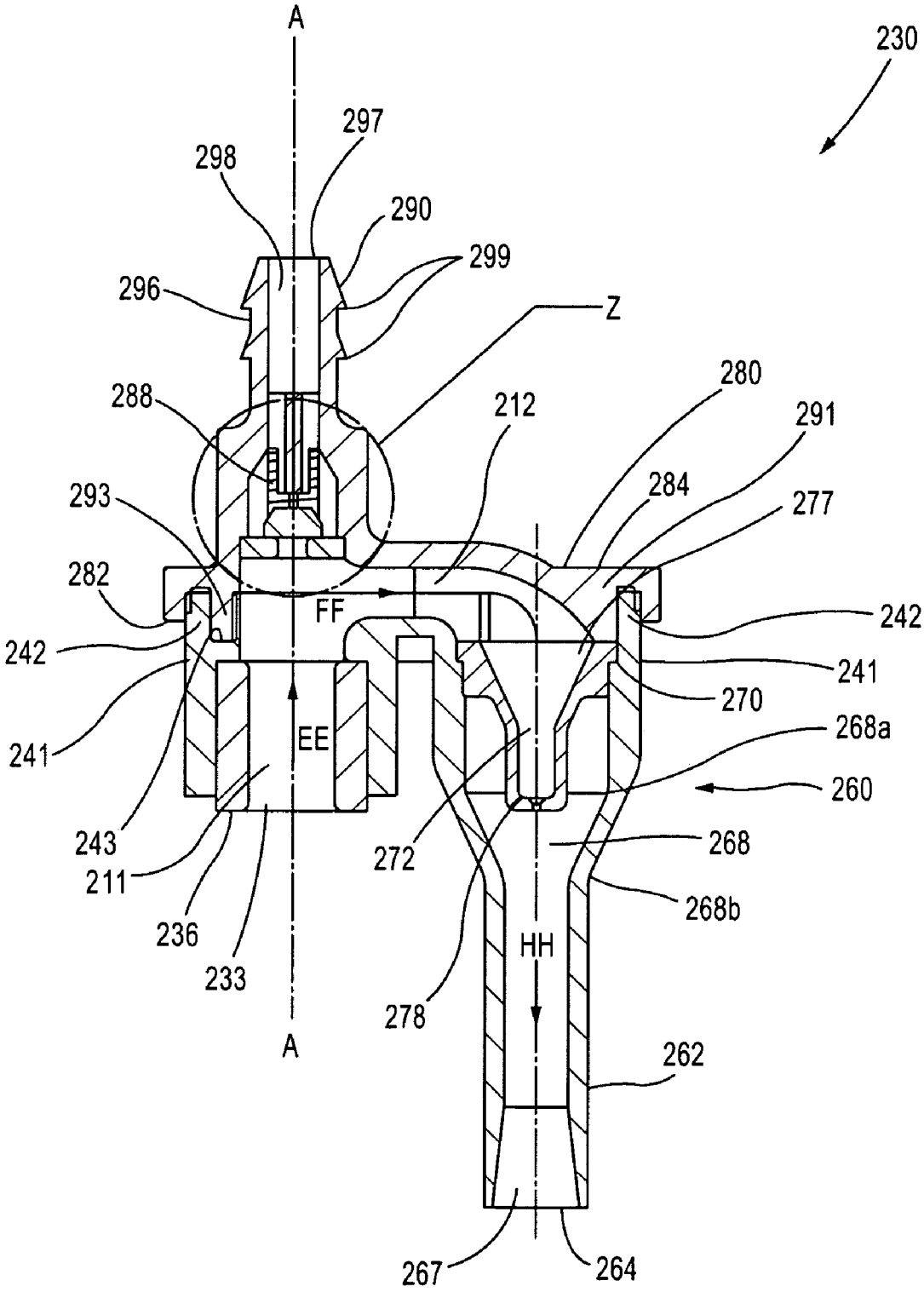
FIG. 10 is a cross-sectional view of the jet pump assembly shown in FIG. 6 taken along line Y-Y in FIG. 9.
Figure 11:
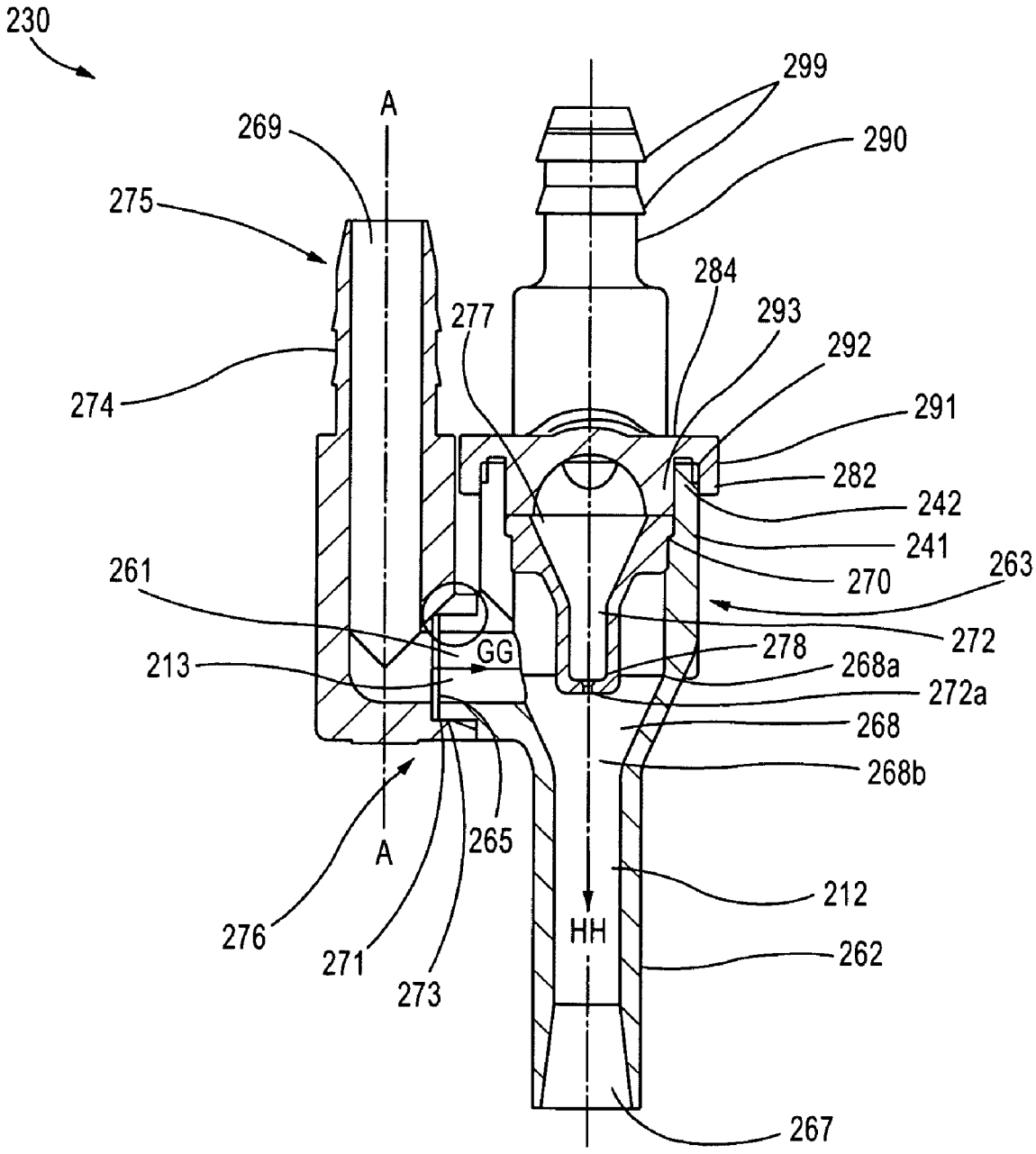
FIG. 11 is a cross-sectional view of the jet pump assembly shown in FIG. 6 taken along line X-X in FIG. 7
Figure 13:
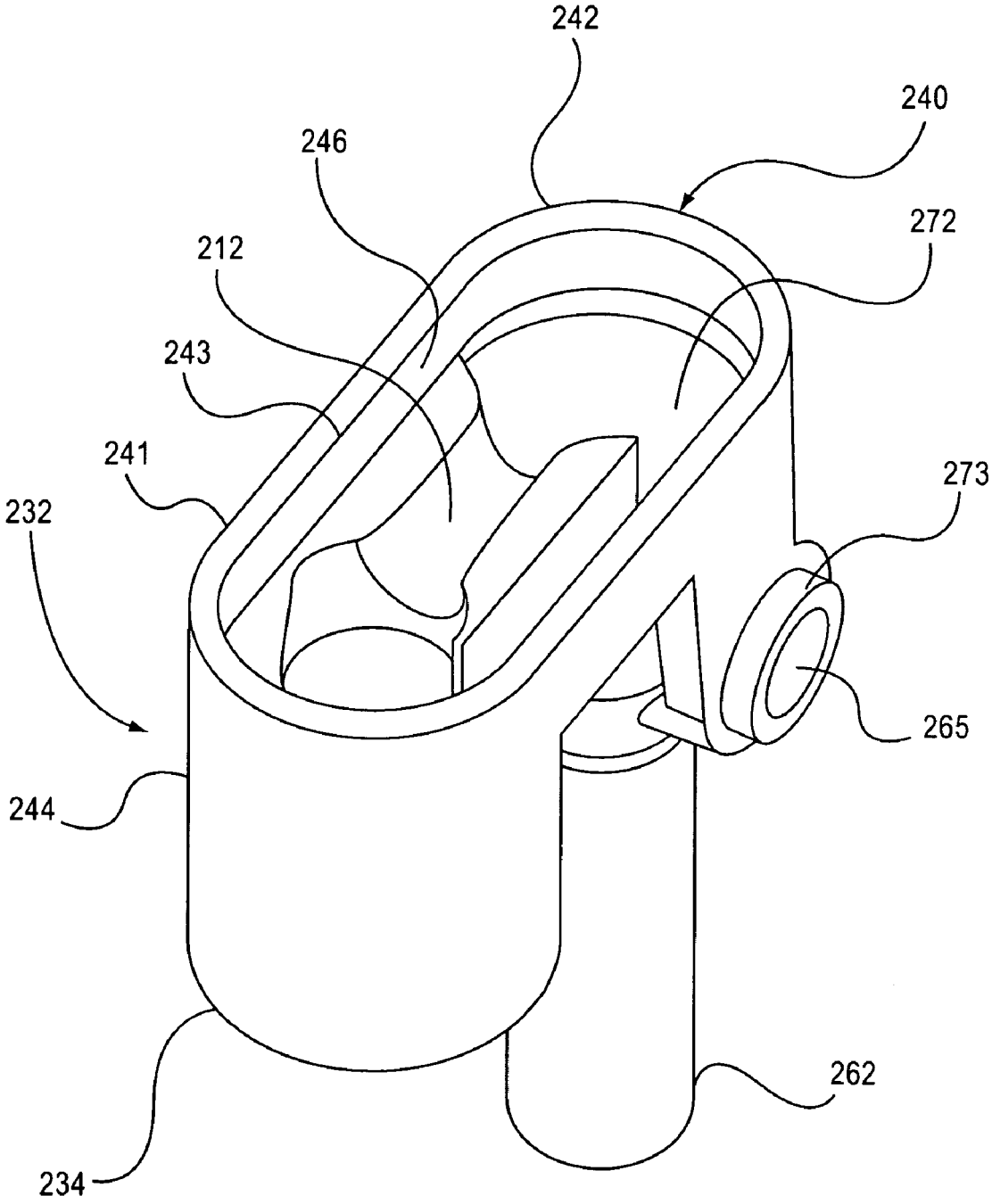
FIG. 13 is a perspective view of the housing of a jet pump assembly shown in FIG. 6.

The second end portion 240 of the housing 232 includes a flange 241 and a sidewall 244. As shown in FIGS. 10, 11, and 13, the flange 241 includes annular protrusions 242. The protrusions 242 define an annular recess 243, shown, for example in FIG. 10. The recess 243 is configured to receive a sidewall 293 of the mounting flange 291 of the cap 280. As described in more detail herein, the protrusions 242 are sized such that they can be matingly received by the recesses 292 defined by the mounting flange 291 and sidewall 293 of the cap 280. As shown in FIG. 13, the sidewall 244 of the housing 232 includes an inner surface 246 that defines a portion of a lumen when the cap 280 is coupled to the housing 232. Similarly stated, the inner surface 246 defines a portion of a boundary of a second flow path 212. Thus, the second end portion 240 of the housing 232 defines, at least in part, a portion of the second flow path 212.

The jet pump portion 260 (as shown, for example in FIGS. 4, 6, and 10-12) includes a coupling portion 273, an inlet connector 274, an outlet tube 262, and a flow control member 272. The jet pump portion 260 defines a lumen 267 and a lumen 261. The lumen 267 is in fluid communication with the lumen of the second end portion 240 of the housing 232. Similarly stated, the lumen 267 of the jet pump portion 260 defines a portion of the second flow path 212. Additionally, the lumen 261 defines a third flow path 213. As described in more detail below, the third flow path 213, which is an inlet flow path, is in fluid communication with the second flow path 212. Similarly stated, the lumen 267 (associated with the second flow path 212) intersects the lumen 261 (associated with the third flow path 213).

A side wall of the jet pump portion 260 defines a venturi 268 within the second flow path 212. Similarly stated, the diameter of the lumen 267 converges from a first diameter at a venturi inlet 268*a* to a second diameter at a venturi exit 268*b*. As shown in FIG. 11, the venturi exit 268*b* is at a location downstream from the intersection of the second flow path 212 and the third flow path 213. Similarly stated, the venturi exit 268*b* is at a location downstream from the intersection of the lumen 261 and the lumen 267. As described above, when fuel flows through the second flow path 212 and passes through the venturi 268, the local pressure of the fuel within the second flow path 212 decreases. Said another way, when fuel passes through the venturi 268, a vacuum is produced. Although shown as a converging venturi, in other embodiments, a venturi can include a converging-diverging venturi.

Figure 14:
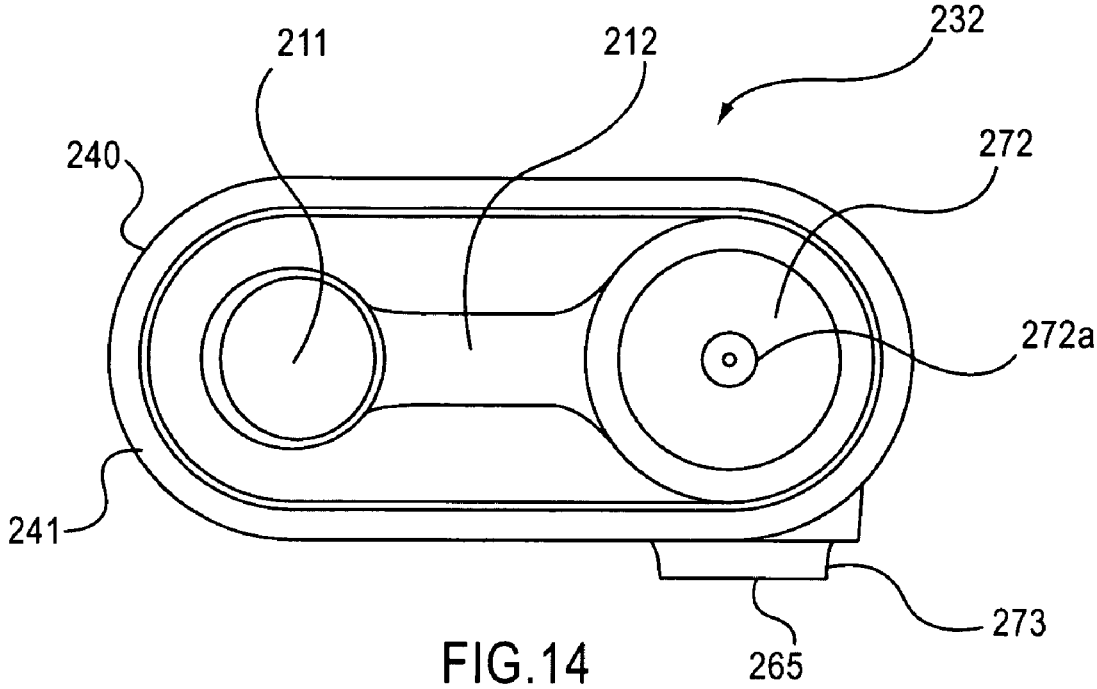
FIG. 14 is a top plan view of the housing shown in FIG. 13 including the flow control member.

The flow control member 272 includes an inlet portion 277 and an outlet portion 278. The inlet portion 277 has a first diameter and the outlet portion 278 has a second diameter smaller than the first diameter (shown, for example, in FIGS. 11 and 12). The flow control member 272 further defines an orifice 272*a*, shown, for example in FIG. 14, configured to be calibrated for controlling, restricting and/or regulating the flow of fuel passing therethrough, as described above. The flow control member 272 is disposed within the second flow path 212 at a location upstream from the intersection of the second flow path 212 and the third flow path 213. The flow control member 272 is configured to engage a shoulder 270 of the housing 232 and/or engage the sidewall adjacent the shoulder 270 via an interference fit. FIG. 14 illustrates a top view of the housing 232 with the cap 280 removed, and the flow control member 272 installed. The flow control member 272 can be, for example, constructed of molded plastic, however any suitable material may be used.

The coupling portion 273 of the jet pump portion 260 defines an opening 265 (shown, for example, in FIGS. 11 and 13) in communication with the lumen 261. The coupling portion 273 is configured to be coupled to the receiving portion 271 of the inlet connector 274, shown, for example, in FIGS. 6 and 11. Accordingly, fuel can flow from the inlet connector (or fitting) 274 into the third flow path 213 via the opening 265.

Figure 6:
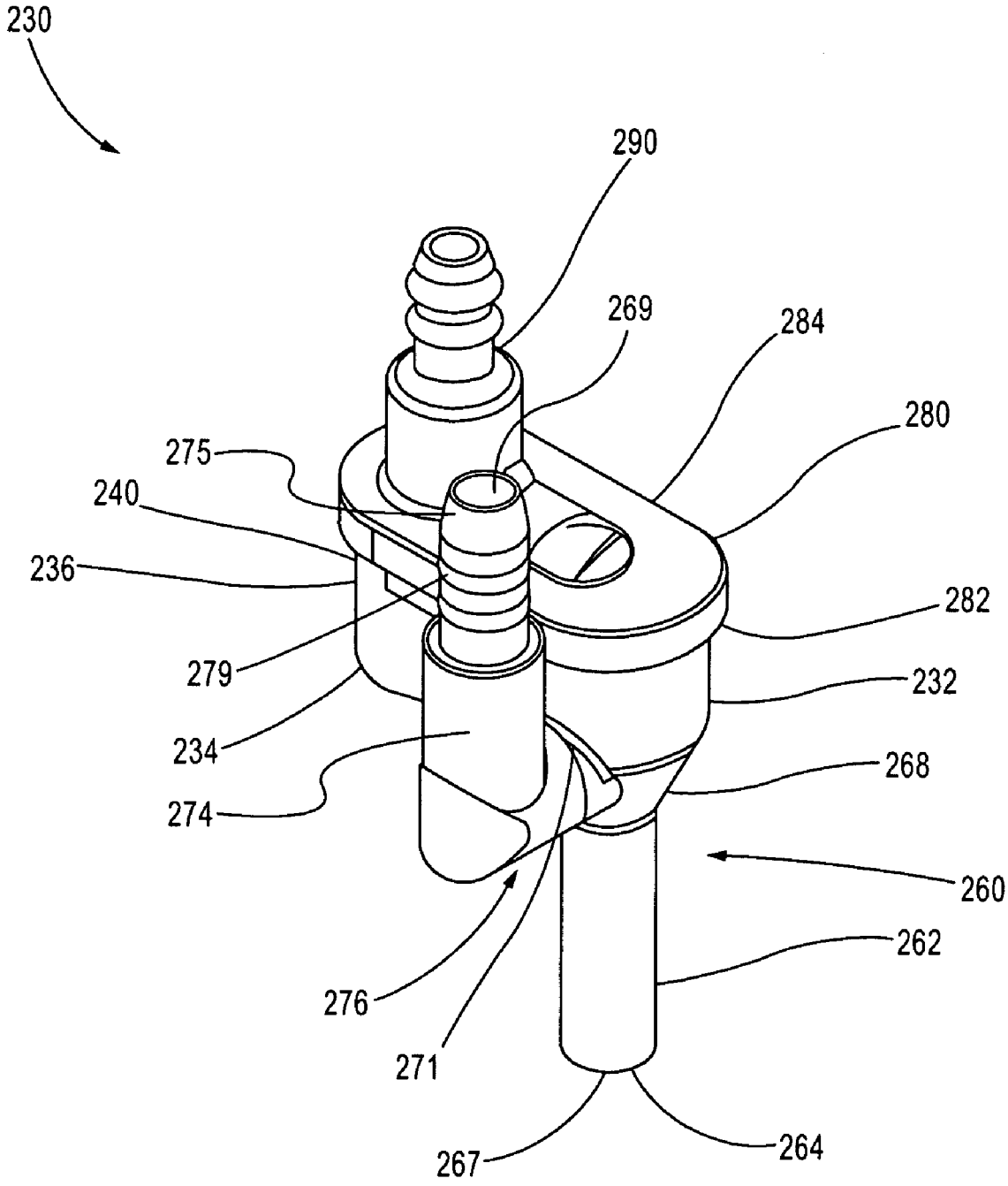
FIG. 6 is a perspective view of a jet pump assembly according to an embodiment.
Figure 7:
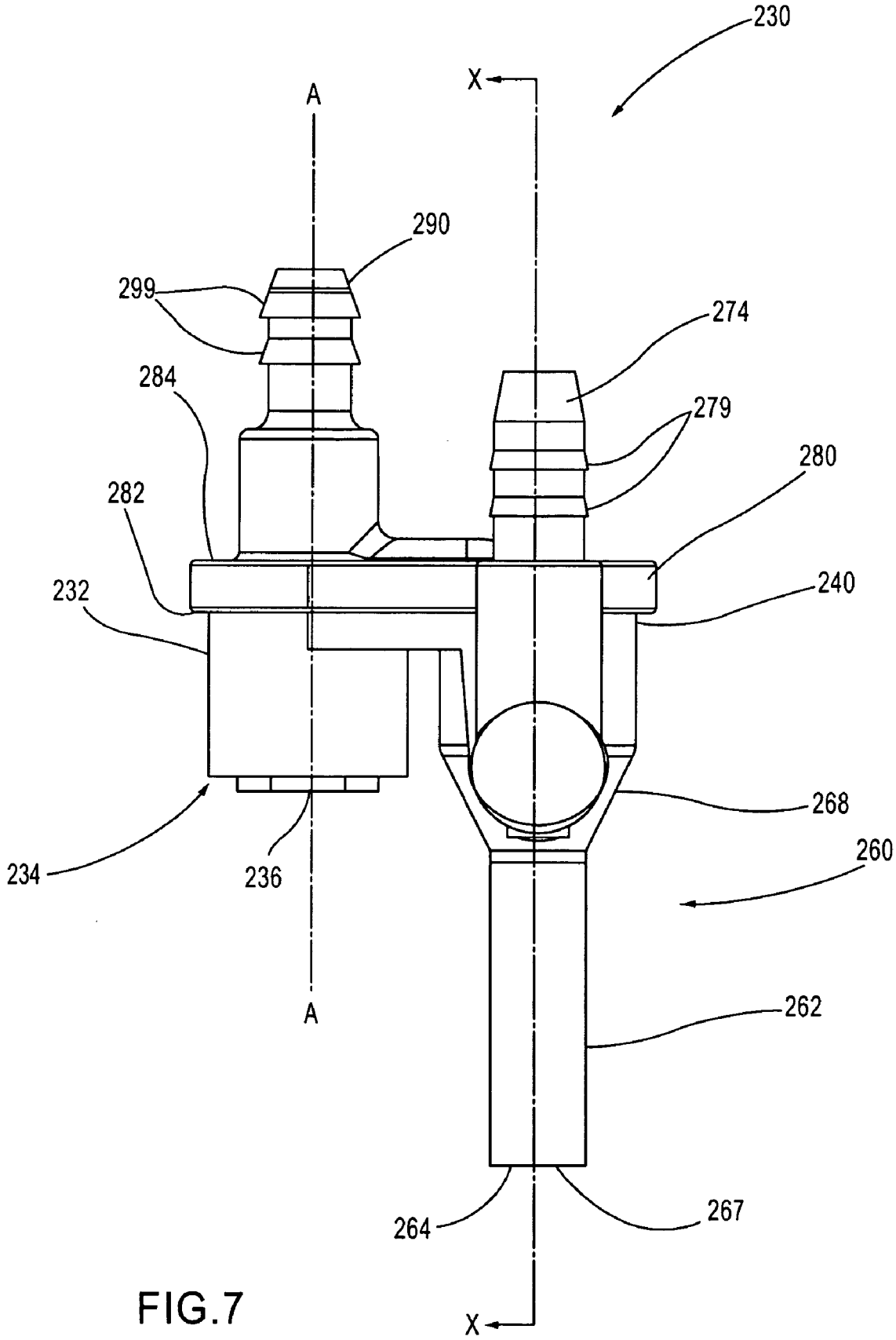
FIG. 7 is a plan view of the jet pump assembly shown in FIG. 6.
Figure 9:
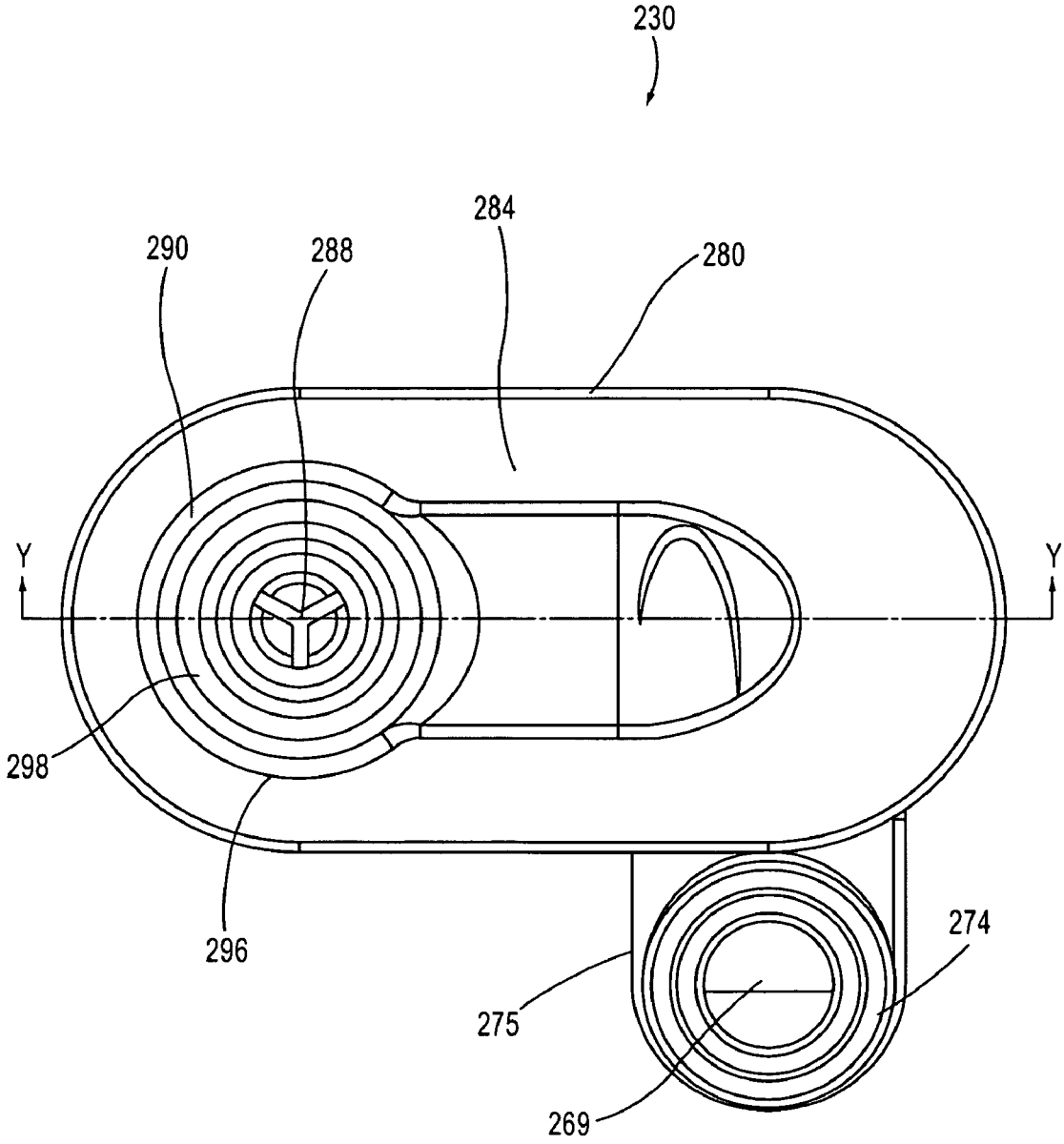
FIG. 9 is a top plan view of the jet pump assembly shown in FIG. 6.

The inlet connector 274, which can be constructed of, for example, molded plastic, includes first end 276, a second end 275, and defines a lumen 269 therethrough, as illustrated, for example, in FIGS. 6, 9, and 11. The lumen 269 is in fluid communication with the opening 265 of the jet pump portion 260 and is therefore in fluid communication with the third flow path 213. The first end 276 includes a receiving portion 271. The receiving portion 271 is configured to matingly receive the coupling portion 273, as shown, for example in FIGS. 6 and 11. The receiving portion 271 can be, for example, spin welded to the coupling portion 273, thereby producing a hermetic and/or fluid tight seal. Alternatively, in some embodiments, an adhesive can be used to couple the receiving portion 271 to the coupling portion 273.

The second end 275 of the inlet connector 274, as shown in FIG. 6, includes a series of barbs 279 configured to fluidically couple and securely retain the second end 275 of the inlet connector 274 within a fuel line 201 (shown in FIG. 5). The fuel line 201 can be, for example, a flexible fuel line configured to convey fuel from a remote portion of a vehicle fuel tank to the inlet connector 274. For example, in some embodiments, the fuel pump module 220 can be disposed within a first portion of a fuel tank (not shown) that is separated from a second (or remote) portion of a fuel tank via baffles, structural members or the like. Although the jet pump assembly 230 is directly coupled to the fuel pump 250, the jet pump 230 can draw fuel from the remote portion of the fuel tank via the fuel line 201 and/or the inlet connector 274.

Figure 8:
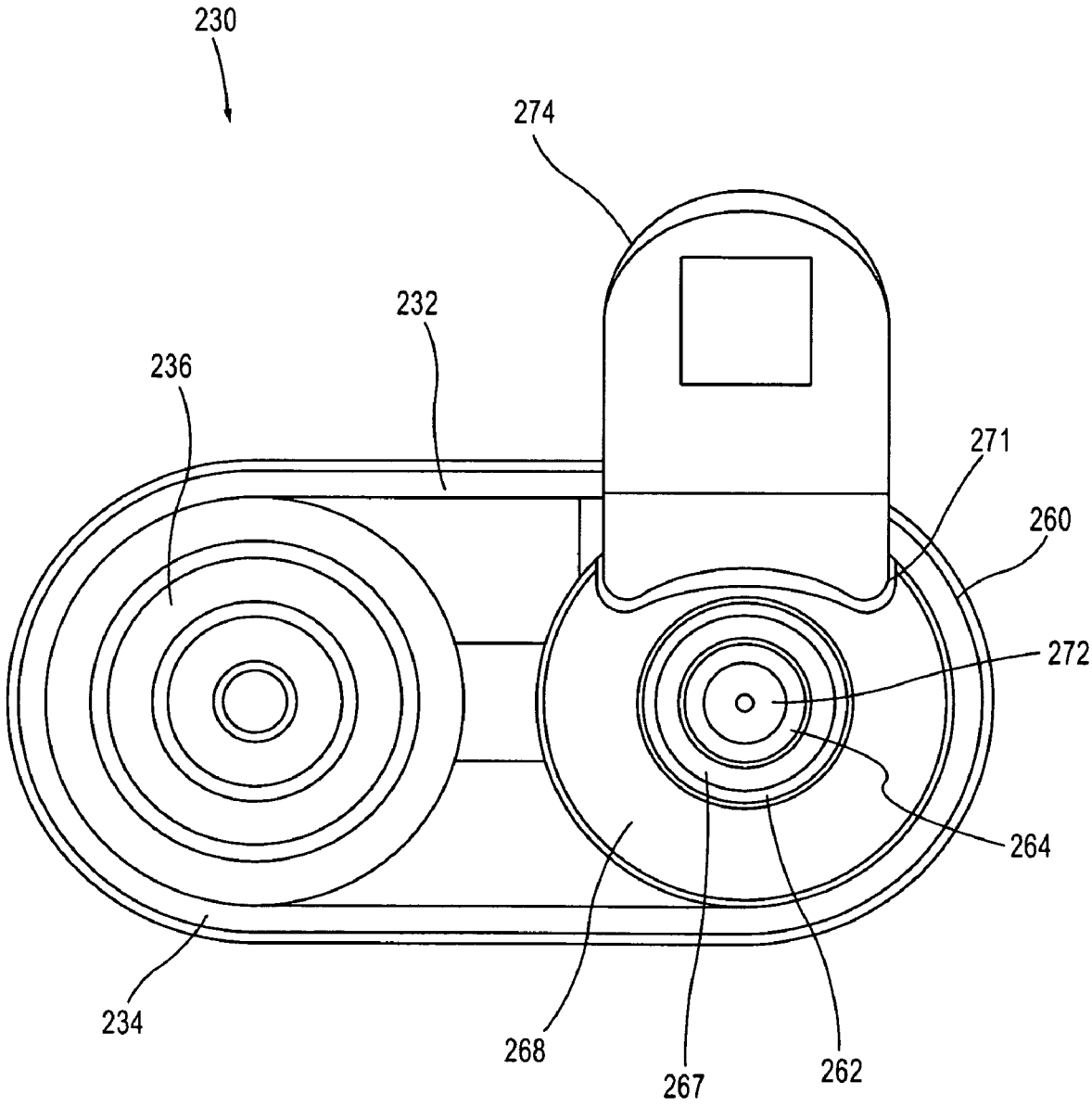
FIG. 8 is a bottom plan view of the jet pump assembly shown in FIG. 6.
Figure 15:
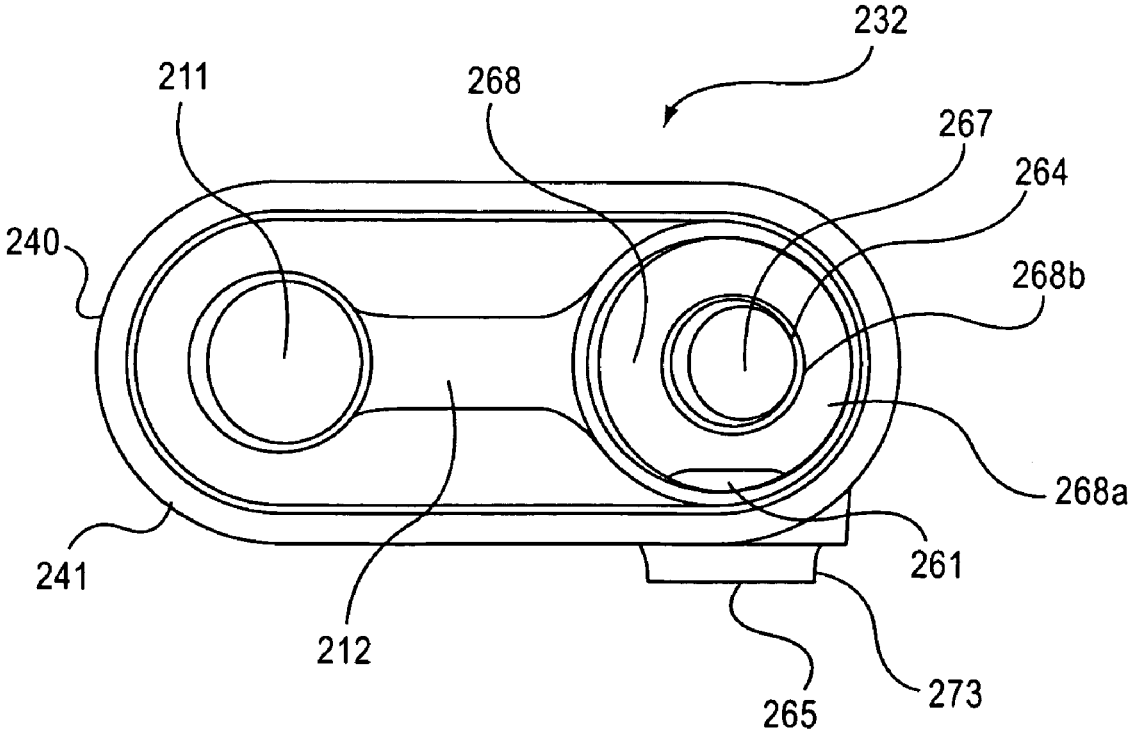
FIG. 15 is a top plan view of the housing shown in FIG. 13 with the flow control member removed.

The outlet (or fuel return) tube 262 defines an opening 264 in fluid communication with the lumen 267. FIG. 15 illustrates a top view of the housing 232 with the cap 280 and the flow control member 272 removed, showing the lumen 267 of the outlet tube 262. The lumen 267 is also shown from the bottom view of the jet pump assembly as shown in FIG. 8. Thus, the outlet tube 262 defines a portion of the second flow path 212. As described in more detail, fuel from the jet pump assembly 230 can be conveyed within the outlet tube 262 to the portion of the tank adjacent the fuel pump 250.

Figure 16:
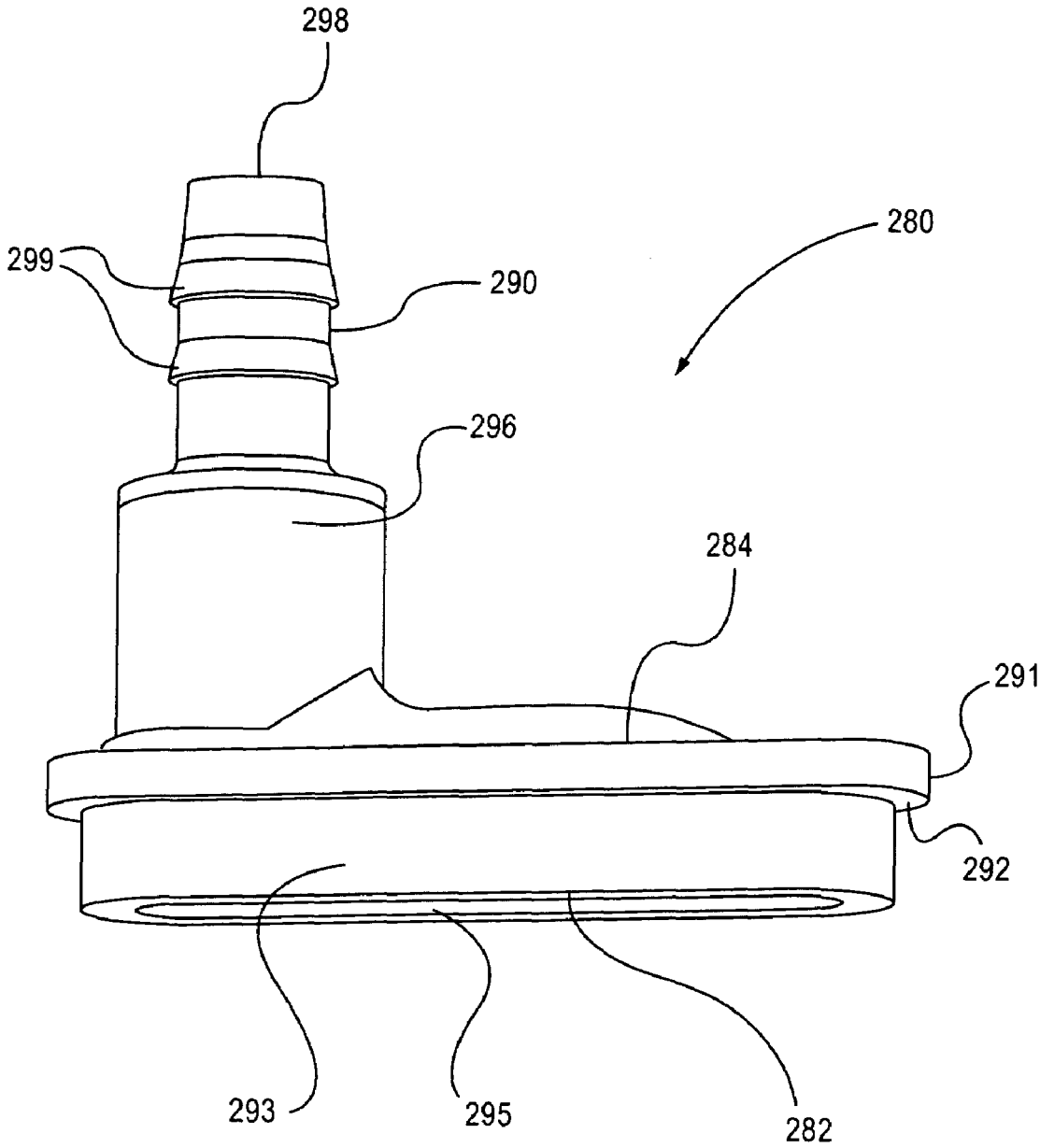
FIG. 16 is perspective view of the cap of a jet pump assembly shown in FIG. 6.
Figure 17:
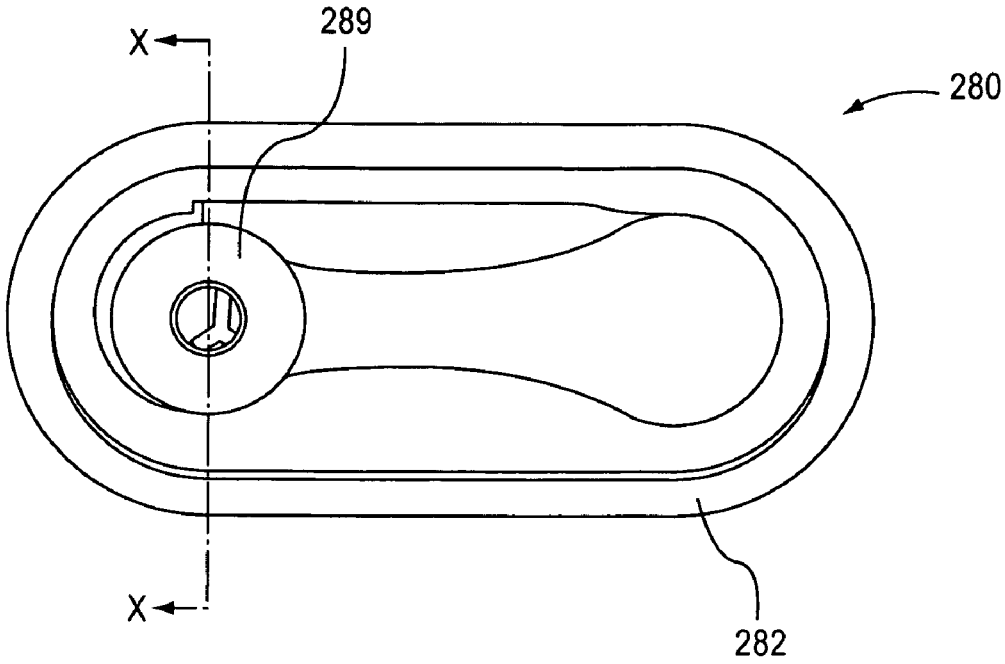
FIG. 17 is a bottom plan view of the cap shown in FIG. 16 including the check valve.
Figure 18:
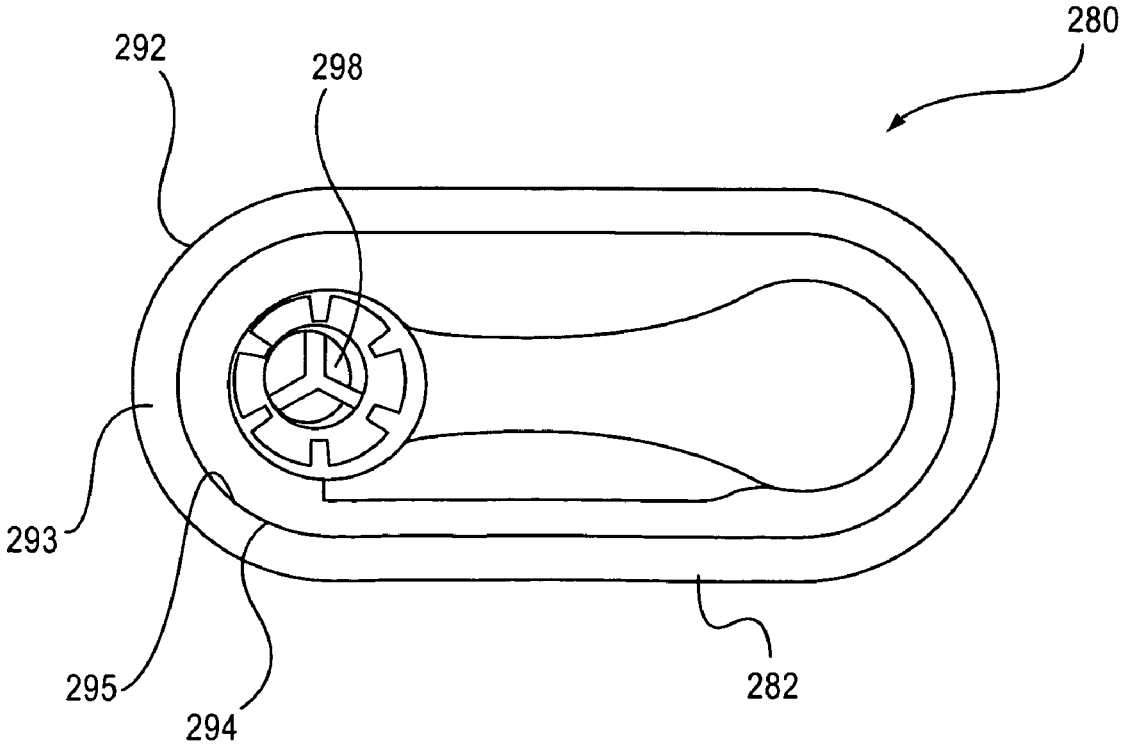
FIG. 18 is a bottom plan view of the cap shown in FIG. 16 with the check valve removed.

As shown in FIGS. 16-18, the cap 280 includes a first end portion 282 (i.e., bottom end portion) and a second end portion 284 (i.e., top end portion). The first end portion 282 includes a sidewall 293 and a mounting flange 291. The sidewall 293 is configured to be matingly received within the annular recess 243 of the flange 241 of the housing 232. The mounting flange 291 extends laterally from an upper portion of the side wall 293. The sidewall 293 and the mounting flange 291 are sized and configured such that they collectively define a recess 292 therebetween. As shown in FIG. 11, the recess 292 is configured to matingly receive the protrusion 242 of the flange 241 of the housing 232. An inner surface 295 of the sidewall 293 of the first end portion 282 defines a portion of a boundary of the second flow path 212. Thus, the cap 280 defines, at least in part, a portion of the second flow path 212.

Figure 12:
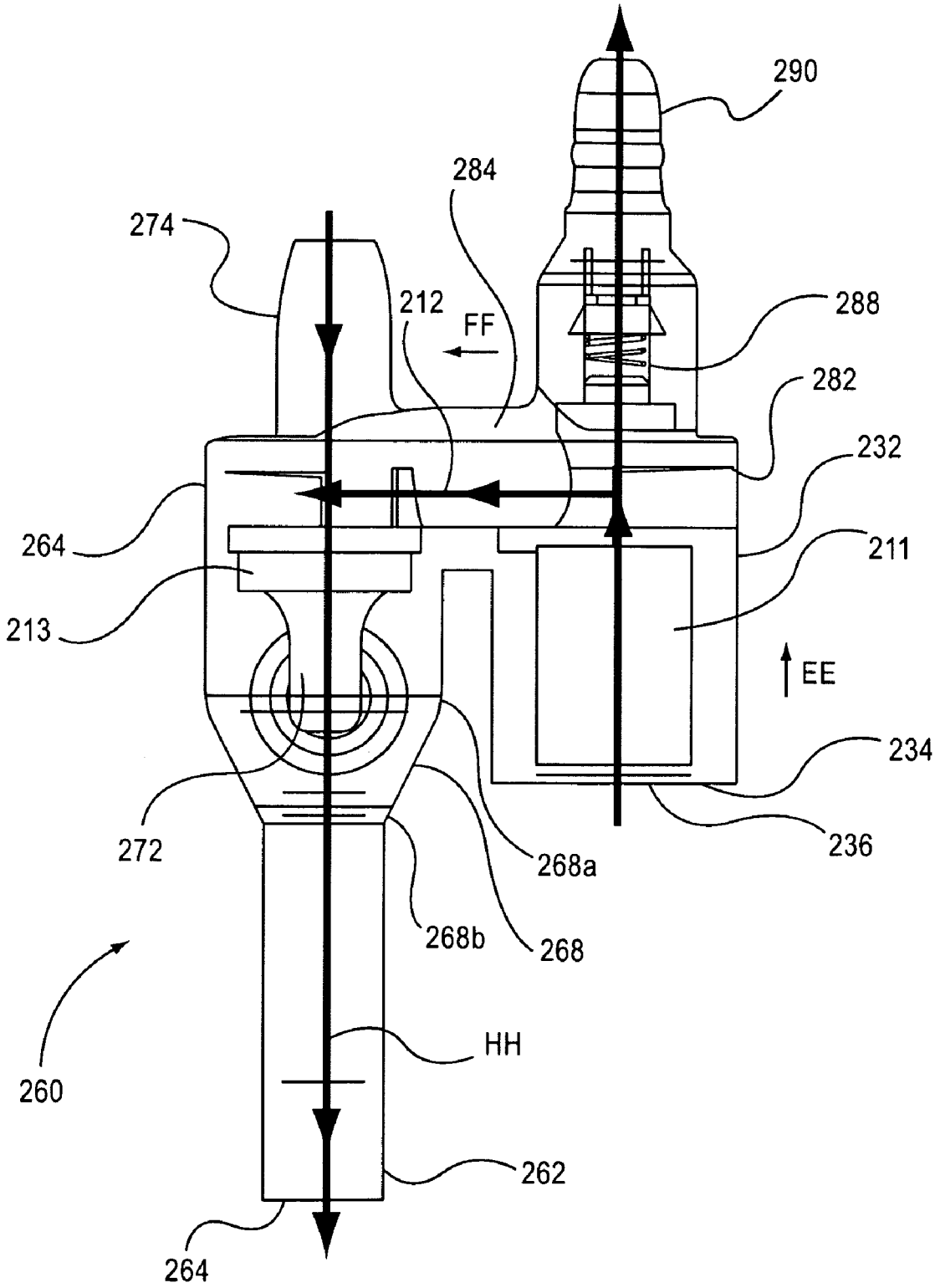
FIG. 12 is a partial cross-sectional side view of the jet pump assembly shown in FIG. 6.

Moreover, when the cap 280 is coupled to the housing 232, the cap 280 and the housing 232 collectively define a portion of the second flow path 212. As described above, the second flow path 212 is configured to convey fuel in the direction as indicated by arrow FF, as shown in FIGS. 10 and 12. When the housing 232 and the cap 280 are coupled together (i.e., when the protrusion 242 of the flange 241 is received in the recess 292) the housing 232 and the cap 280 form a fluid-tight seal (i.e., a seal that substantially prevents a liquid and/or gas from passing around an outer edge of the housing or the cap). In some embodiments, the fluid-tight seal can be a hermetic seal (i.e., a seal that substantially prevents a gas from passing therethrough). In some embodiments, the hermetic seal can be formed by ultrasonically welding the cap 280 to the housing 232.

The second end portion 284 of the cap 280 includes an outlet fitting 290, a check valve 288, a spring 287, and a check valve base 289. The outlet fitting 290, can be, for example, a monolithically formed portion of the second end portion 284 of the cap 280. The outlet fitting 290 includes an outer surface 296 and defines a lumen 298 having a center line coaxial with the longitudinal axis A-A of the lumen 233 defined by the sleeve 236 of the housing 232 (shown, for example in FIGS. 7 and 11). The lumen 298 of the outlet fitting 290 is in fluid communication with the lumen 233 defined by the sleeve 236 of the housing 232 and is configured to define a portion of the first flow path 211. Said another way, the lumen 298 of the outlet fitting 290 and the lumen 233 of the housing 232 collectively define a portion of the first flow path 211.

The lumen 298 of the outlet fitting 290 is further configured to receive and retain the check valve 288, the check valve base 289, and the spring 287, as shown, for example, in FIGS. 9, 10, 12, and 17-19. The check valve 288 is disposed within the lumen 298 of the outlet fitting 290 and is configured to serve as a one-way valve, allowing the fuel to flow through the lumen 298 of the outlet fitting 290 in only one direction. In this manner, the check valve 288 prevents system pressure loss upon fuel system shut down. The check valve 288 can be constructed of any suitable material, for example, molded rubber, steel, or plastic.

The spring 287 is disposed within the lumen 298 of the outlet fitting 290 and is disposed adjacent the check valve 288. The spring 287 can be, for example, a coil spring. The spring 287 is configured to bias the check valve 288 in the closed position, as shown in FIG. 19.

Figure 19:
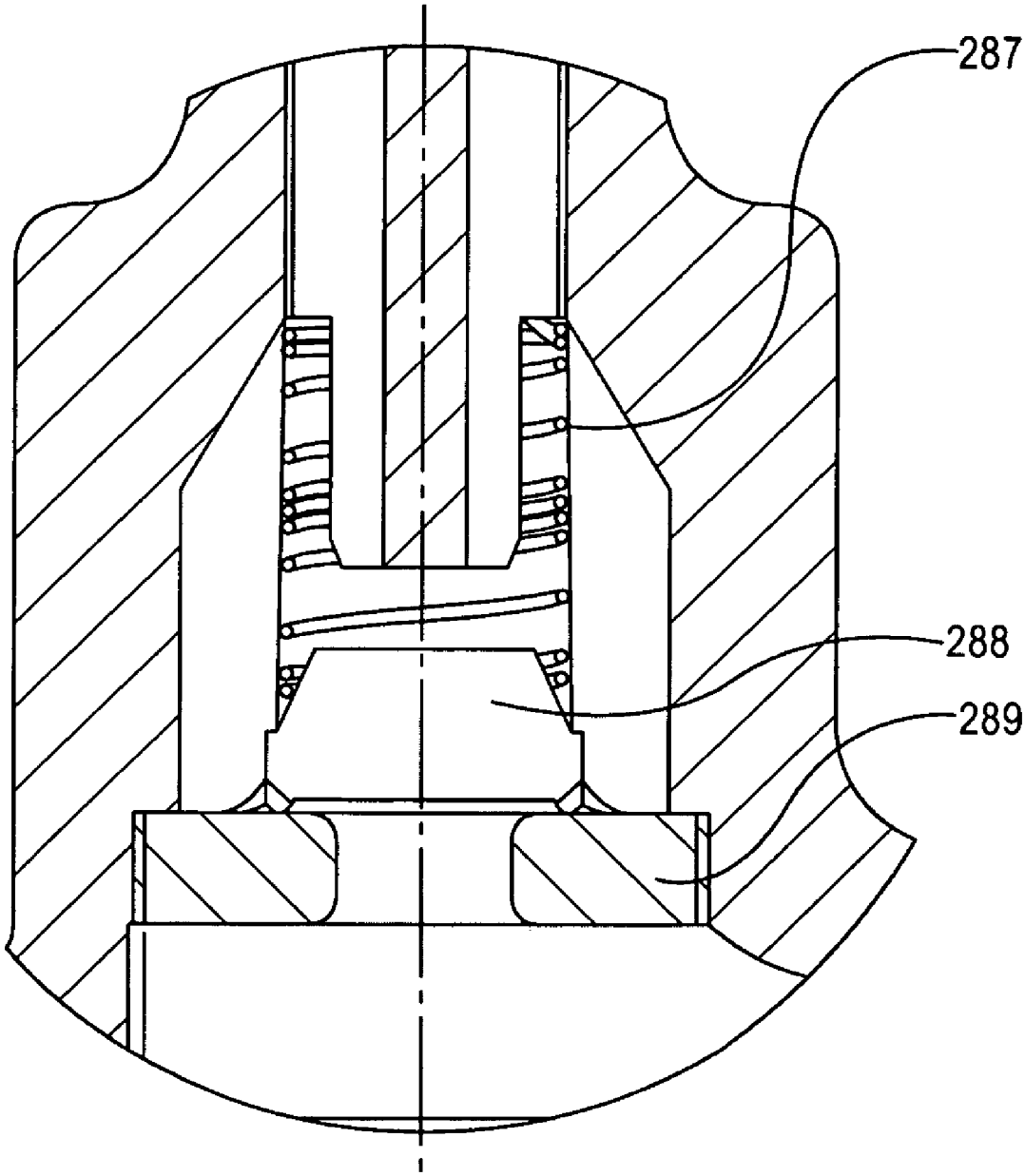
FIG. 19 is a cross-sectional view of the portion of the jet pump assembly as shown by the region Z in FIG. 10, taken along the line X-X in FIG. 18.

The check valve base 289 is disposed within the lumen 298 of the outlet fitting 290 and is coupled to and retains the check valve 288 and spring 287 (as best shown in FIG. 19). FIG. 17 illustrates a bottom view of the cap 280 with the check valve base 289 installed in the outlet fitting 290 of the cap 280. The check valve base 289 is received in the outlet fitting 290 (shown, for example, in FIGS. 17 and 19) and is configured to serve as a sealing surface for the check valve 288. When the check valve base 289 is secured within the outlet fitting 290, a fluid-tight seal (i.e., a seal that substantially prevents a liquid and/or gas from passing around an outer edge of the housing or the cap) is formed. In some embodiments, the fluid-tight seal can be a hermetic seal (i.e., a seal that substantially prevents a gas from passing therethrough). The check valve base 289 can be secured within the outlet fitting 290 by, for example, ultrasonically welding the check valve base 289 (and attached check valve 288 and spring 287) to the outlet fitting 290. In other embodiments, however, any means to securely retain the check valve base 289 within the outlet fitting 290 can be used. The check valve base 289 can be constructed of any suitable material, for example, molded plastic, steel, or any suitable metal alloy.

The outer surface 296 of the outlet fitting 290 as shown, for example, in FIGS. 10, 11 and 16 includes a series of barbs 299 configured to fluidically couple and securely retain the outlet fitting 290 within a fuel supply line (not shown). The outer surface 296 is configured to be coupled to a fuel line (not shown) providing fluid communication between the lumen 298 of the outlet fitting 290 and the fuel line.

In use, the fuel pump 250 receives fuel from a first portion of the fuel tank 206 (i.e., the portion of the tank in which the fuel pump module 220 is disposed) via a fuel inlet portion. The fuel pump 250 pumps fuel into the jet pump assembly 230 such that a portion of the pressurized fuel from the fuel pump 250 is conveyed through the first flow path 211 to the check valve 288 and the outlet fitting 290, as shown by the arrow EE in FIG. 12. The fuel is then conveyed to a fuel injector rail through a fuel supply line (not shown) coupled to the outlet fitting 290. Pressurized fuel from the fuel pump 250 is also conveyed to the second flow path 212, as indicated by the arrow FF in FIG. 12. In this manner, the first flow path 211 and the second flow path 212 define a parallel flow circuit through which fuel from the fuel pump 250 can flow. The flow rate of fuel within the second flow path 212 is controlled by the flow control member 272. Said another way, the flow control member 272 regulates the fuel flow split and/or the ratio of fuel flow between the first flow path 211 and the second flow path 212.

When fuel flows through the second flow path 212 and passes through the venturi 268, the local pressure of the fuel within the portion of the second flow path 212 adjacent the venturi 268 decreases compared to the pressure of the fuel within the remainder of the second flow path 212. Said another way, when fuel passes through the venturi 268, a localized area of low pressure and/or vacuum is produced. Accordingly, the vacuum causes fuel to be drawn into the jet pump housing 232 via the third flow path 213, as indicated by the arrow GG in FIG. 11. More particularly, the fuel can be drawn from a remote portion of the fuel tank (i.e., a portion separated from the portion in which the fuel pump module 220 is disposed via baffles, structural members or the like) via the fuel line 201. The fuel flowing within the third flow path 213 is combined with the fuel flowing within the second flow path 212 and is returned to the fuel tank as shown by the arrow HH in FIG. 12. More particularly, the fuel exiting the jet pump assembly 230 is directed to the portion of the tank in which the fuel pump module 220 is disposed. In this manner, fuel can be transferred from a remote location within a tank to a location of the tank adjacent to the fuel pump 250 to prevent starvation of the fuel pump 250.

Although the outer portion 296 of the outlet fitting 290 is illustrated as including a series of barbs 299 to couple and securely retain the outlet fitting 290 to a fuel supply line, it should be understood that in other embodiments, any suitable retaining means can be used. For example, in some embodiments the outlet fitting can be retained within a fuel line by a coupling member, such as a clamp or an adhesive. In other embodiments, a threaded union, for example may be used to couple the outlet fitting to the fuel supply line.

Although the second end 275 of the inlet portion 274 is illustrated as including a series of barbs 279, it should be understood that in other embodiments, any suitable retaining means can be used. For example, in some embodiments the outlet fitting can be retained within a fuel line by a coupling member, such as a clamp or an adhesive.

Although the longitudinal axis A-A of the sleeve 236 of the housing 232 (shown, for example, in FIGS. 7 and 10), is illustrated and described as being coaxial with a longitudinal axis of the lumen 298 of the outlet fitting 290 of the cap 280, in other embodiments, the longitudinal axes of the sleeve 236 of the housing 232 and/or the lumen 298 of the outlet fitting 290 can be offset from one another.

Figure 20:
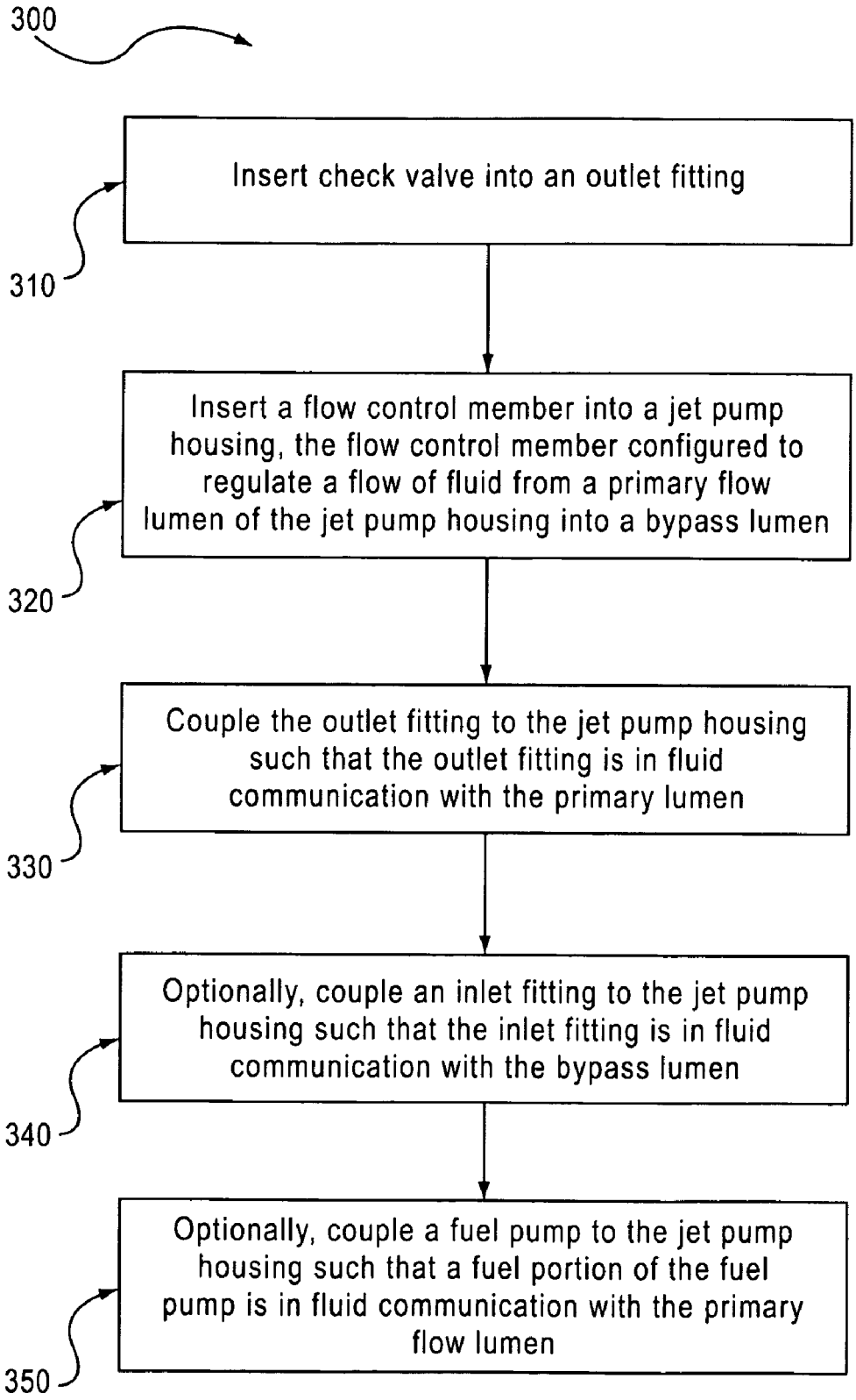
FIG. 20 is a flowchart of a method of assembly according to an embodiment.

FIG. 20 is a flowchart for a method 300 of assembling a fuel pump module according to an embodiment. The method includes inserting a check valve into an outlet fitting, 310. The check valve can be any check valve of the types shown and described herein. For example, in some embodiments, the check valve can include a valve member, a spring, and a check valve base as described above with reference to FIG. 19. In some embodiments, the check valve base can be ultrasonically welded to the outlet fitting. In some embodiments, the check valve can be disposed within the outlet fitting such that a substantially fluid-tight seal is formed between the check valve and the outlet fitting.

At 320, a flow control member is inserted into a bypass lumen of a jet pump housing. The jet pump housing includes a surface that defines a venturi within the bypass lumen. The jet pump housing further defines a primary flow lumen in fluid communication with the bypass lumen. The flow control member is configured to restrict, control, and/or regulate the flow of a fluid from the primary flow lumen into the bypass lumen. The jet pump housing can be, for example, any of the jet pump housings shown and described herein (e.g., the jet pump housing 232). The flow control member can include, for example, an orifice to restrict, control, regulate the flow within the bypass lumen. In some embodiments, for example, the flow control member can be similar to the flow control member 272 shown and described above.

The outlet fitting is coupled to the jet pump housing such that the outlet fitting is in fluid communication with the primary flow lumen, 330. In some embodiments, for example, the outlet fitting can be included within a cover (e.g., similar to the cover 280 shown and described above) that is matingly coupled to the jet pump housing. In some embodiments, the outlet fitting can be coupled to the jet pump housing such that a fluid-tight seal is formed.

In some embodiments, the method optionally includes coupling an inlet fitting to the jet pump housing such that the inlet fitting is in fluid communication with the bypass lumen, 340. In some embodiments, the method optionally includes coupling a fuel pump to the jet pump housing such that a fuel outlet portion of the fuel pump is in fluid communication with the primary flow lumen, 350. In some embodiments, for example, a fuel pump can be coupled to the jet pump housing such that a portion of the fuel pump is disposed within the jet pump housing.

Although the method of assembling a fuel pump module has been illustrated and described in one order, the activities can occur in a different order. For example, in some embodiments, the flow control member is inserted into the jet pump portion of the jet pump assembly prior inserting the check valve into the outlet fitting. Furthermore, each activity is not required for assembling the fuel pump module. For example, in some embodiments, the inlet portion can be monolithically formed component of the housing (i.e., of the jet pump portion), wherein no coupling or spin-welding is necessary.

While various embodiments have been described above, it should be understood that they have been presented by way of example only, and not limitation. While the embodiments have been particularly shown and described, it will be understood that various changes in form and details may be made. For example, although the fuel pump modules have been shown and described above as being disposed within a fuel tank, in other embodiments, a fluid delivery module of the types shown and described herein can be disposed within any suitable tank. For example, in some embodiments, a fluid delivery module can be configured to convey a hydraulic fluid, a saline solution, water or any other suitable fluid as part of a fluidic process. In such embodiments, the fluid delivery module can be disposed in any suitable container (e.g., a reservoir, a barrel, a tank, a flow conduit or the like). Moreover, in some embodiments, the fluid delivery module can be disposed outside of the fluid reservoir.

Although various embodiments have been described as having particular features and/or combinations of components, other embodiments are possible having a combination of any features and/or components from any of embodiments as discussed above.

What is claimed is:

1. An apparatus comprising:

a housing configured to receive a portion of a fuel pump, the housing defining a first flow path, a second flow path and a third flow path, the first flow path in fluid communication with a fuel outlet portion of the fuel pump when the portion of the fuel pump is disposed within the housing, the second flow path in fluid communication with the first flow path, the third flow path in fluid communication with the second flow path, a side wall of the housing defining a venturi within the second flow path at a location downstream from an intersection of the third flow path and the second flow path; and a flow control member disposed within the second flow path at a location upstream from the intersection of the third flow path and the second flow path, the flow control member configured to regulate a continuous flow of a fluid within the second flow path.

2. The apparatus of claim 1, wherein the housing includes a cover defining a portion of the first flow path and a portion of the second flow path.

3. The apparatus of claim 1, further comprising:

a check valve disposed within the first flow path at a location downstream of an intersection of the second flow path and the first flow path.

4. The apparatus of claim 1, wherein:

the housing includes an outlet fitting that defines a portion of the first flow path at a location downstream of an intersection of the second flow path and the first flow path, the portion of the first flow path defined by the outlet fitting and the second flow path defining a parallel flow circuit.

5. The apparatus of claim 1, further comprising:

a fitting coupled to the housing such that the fitting is in fluid communication with the third flow path.

6. The apparatus of claim 1, further comprising:

a tube having a first end portion configured to be disposed in a first portion of a fuel tank, and a second end portion coupled to the housing such that the tube is in fluid communication with the third flow path.

7. The apparatus of claim 1, wherein the flow control member defines an orifice configured to regulate the continuous flow of the fluid within the second flow path.

8. An apparatus comprising:

a housing configured to be directly coupled to a fuel pump, the housing defining a first lumen and a second lumen, the first lumen in fluid communication with a fuel outlet portion of the fuel pump, the second lumen in fluid communication with the first lumen, a side wall of the housing defining a venturi within the second lumen;

a flow control member disposed within the second lumen at a location upstream from the venturi, the flow control member defining an orifice configured to regulate a continuous flow of a fluid within the second lumen; and an outlet fitting coupled to the housing such that the outlet fitting is in fluid communication with the first lumen, the outlet fitting and the second lumen defining a parallel flow circuit.

9. The apparatus of claim 8, wherein the housing defines a third lumen in fluid communication with the second lumen, the third lumen configured to be fluidically coupled to a suction tube, the venturi disposed at a location downstream from an intersection of the third lumen and the second lumen.

10. The apparatus of claim 8, further comprising:

a tube having a first end portion configured to be disposed in a first portion of a fuel tank, and a second end portion coupled to the housing such that the tube is in fluid communication with the second lumen.

11. The apparatus of claim 8, further comprising:

a check valve disposed within the outlet fitting.

12. A method, comprising:

inserting a check valve into an outlet fitting;

inserting a flow control member into a bypass lumen defined by a jet pump housing, the flow control member and the bypass lumen collectively forming an interference fit, a surface of the jet pump housing defining a venturi within the bypass lumen, the jet pump housing defining a primary flow lumen in fluid communication with the bypass lumen, the flow control member configured to regulate a flow of a fluid from the primary flow lumen to the bypass lumen; and coupling the outlet fitting to the jet pump housing such that the outlet fitting is in fluid communication with the primary flow lumen.

13. The method of claim 12, further comprising:

coupling an inlet fitting to the jet pump housing such that the inlet fitting is in fluid communication with the bypass lumen.

14. The method of claim 12, further comprising:

coupling a fuel pump to the jet pump housing such that a fuel outlet portion of the fuel pump is in fluid communication with the primary flow lumen.

15. The method of claim 12, further comprising:

coupling a fuel pump to the jet pump housing such that a portion of the fuel pump is disposed within the jet pump housing.

16. The method of claim 12, wherein the coupling includes welding the outlet fitting to the jet pump housing.

* * * * *